US010214827B2

(12) United States Patent
Cabot et al.

(10) Patent No.: US 10,214,827 B2
(45) **Date of Patent: *Feb. 26, 2019**

(54) MICROCRYSTALLINE ANODIC COATINGS AND RELATED METHODS THEREFOR

(71) Applicant: SANFORD PROCESS CORPORATION, Woonsocket, RI (US)

(72) Inventors: Timothy P. Cabot, Cambridge, MA (US); John J. Tetrault, Cumberland, RI (US); Dong-Jin Sung, Wayland, MA (US)

(73) Assignee: SANFORD PROCESS CORPORATION, Woonsocket, RI (US)

( * ) Notice: Subject to any disclaimer, the term of this patent is extended or adjusted under 35 U.S.C. 154(b) by 365 days.

This patent is subject to a terminal disclaimer.

(21) Appl. No.: 15/041,725

(22) Filed: Feb. 11, 2016

(65) Prior Publication Data

US 2016/0160372 A1 Jun. 9, 2016

Related U.S. Application Data

(60) Continuation-in-part of application No. 14/105,049, filed on Dec. 12, 2013, now Pat. No. 9,260,792, (Continued)

(51) Int. Cl.
*C23C 22/06* (2006.01)
*C25D 11/24* (2006.01)
(Continued)

(52) U.S. Cl.
CPC ..... *C25D 11/246* (2013.01); *C23C 8/02* (2013.01); *C23C 8/10* (2013.01); *C23C 8/80* (2013.01);
(Continued)

(58) Field of Classification Search
None
See application file for complete search history.

(56) References Cited

U.S. PATENT DOCUMENTS 3,616,298 A 10/1971 Fassell, Jr.
3,616,311 A 10/1971 Barkman et al.
(Continued)

FOREIGN PATENT DOCUMENTS

CA 829283 A 12/1969
EP 0397216 A1 11/1990
(Continued)

OTHER PUBLICATIONS

AACOA, Inc., Aluminum Anodizing Report, 21 pages, www.aacoa.com/anodizing, Oct. 24, 2009.
(Continued)

*Primary Examiner* — Lois L Zheng
(74) *Attorney, Agent, or Firm* — Lando & Anastasi, LLP

(57) ABSTRACT

Methods of preparing metal and metal alloys with partially microcrystalline anodic coatings are disclosed. Associated article therefrom are correspondingly disclosed. The partially microcrystalline anodic coatings exhibit fade and pattern removal resistance when subjected to sterilization processes. Partially microcrystalline anodic coating can be prepared by impregnation of micropores of a metal or metal substrate with metal precursor species, conversion of the metal precursor species into metal hydroxides, and one or more additional treatments to promote phase transformation of the metal hydroxide product into metal oxides solids and bonding with metastable metal oxide substance in the pore structure of the metal or metal alloy substrate.

25 Claims, 13 Drawing Sheets

Related U.S. Application Data which is a division of application No. 12/783,130, filed on May 19, 2010, now Pat. No. 8,609,254.

(51) Int. Cl.

| | |
|---|---|
| ***C23C 8/02*** | (2006.01) |
| ***C23C 8/80*** | (2006.01) |
| ***C25D 11/04*** | (2006.01) |
| ***C25D 11/18*** | (2006.01) |
| ***C23C 8/10*** | (2006.01) |
| *C25D 11/08* | (2006.01) |

(52) U.S. Cl.

CPC ..... *C25D 11/04* (2013.01); *C25D 11/045* (2013.01); *C25D 11/18* (2013.01); *C25D 11/24* (2013.01); *C25D 11/243* (2013.01); *C25D 11/08* (2013.01)

(56) References Cited

U.S. PATENT DOCUMENTS

| | | | |
|---|---|---|---|
| 3,652,429 | A | 3/1972 | Deltombe |
| 3,849,264 | A | 11/1974 | Weber et al. |
| 4,031,275 | A | 6/1977 | Alexander |
| 4,045,599 | A | 8/1977 | Remaley et al. |
| 4,066,816 | A | 1/1978 | Sheasby et al. |
| 4,084,014 | A | 4/1978 | Fabregas |
| 4,659,333 | A | 4/1987 | Schaub |
| 4,861,440 | A | 8/1989 | Covino |
| 4,882,237 | A | 11/1989 | Koyama |
| 5,139,449 | A | 8/1992 | Akahori |
| 5,411,607 | A | 5/1995 | Basaly et al. |
| 5,624,716 | A | 4/1997 | Shulman |
| 5,658,529 | A | 8/1997 | Feldman et al. |
| 5,716,322 | A | 2/1998 | Hui et al. |
| 5,942,438 | A | 8/1999 | Antonoplos et al. |
| 6,156,677 | A | 12/2000 | Brown Reed et al. |
| 6,258,463 | B1 | 7/2001 | Corridan |
| 6,444,304 | B1 | 9/2002 | Hisamoto et al. |
| 6,511,532 | B2 | 1/2003 | Matzdorf et al. |
| 6,686,053 | B2 | 2/2004 | Wada et al. |
| 6,787,179 | B2 | 9/2004 | Timm et al. |
| 6,818,116 | B2 | 11/2004 | Stoffer et al. |
| 6,869,701 | B1 | 3/2005 | Aita et al. |
| 6,884,393 | B2 | 4/2005 | Hui et al. |
| 7,323,230 | B2 | 1/2008 | Doan et al. |
| 7,824,783 | B2 | 11/2010 | Yousefiani |
| 9,260,792 | B2 * | 2/2016 | Cabot ..... C23C 8/02 |
| 2002/0117236 | A1 | 8/2002 | Matzdorf et al. |
| 2004/0040854 | A1 | 3/2004 | Naganuma |
| 2005/0029115 | A1 | 2/2005 | Kuo et al. |
| 2005/0056546 | A1 | 3/2005 | Kia et al. |
| 2005/0218004 | A1 | 10/2005 | Charles |
| 2005/0271859 | A1 | 12/2005 | Tuss et al. |
| 2009/0038712 | A1 | 2/2009 | Chen et al. |
| 2009/0202845 | A1 | 8/2009 | Hodges et al. |
| 2011/0284383 | A1 | 11/2011 | Cabot et al. |

FOREIGN PATENT DOCUMENTS

| | | | |
|---|---|---|---|
| EP | 0439911 | A1 | 8/1991 |
| GB | 406988 | A | 2/1934 |
| JP | 07-180091 | | 7/1995 |
| JP | 10-018085 | | 1/1998 |
| JP | 11-012797 | | 1/1999 |
| WO | 9736036 | A1 | 10/1997 |
| WO | 05014894 | A1 | 2/2005 |

OTHER PUBLICATIONS

First Office Action on Chinese Patent Application No. 201180024365.2, dated Apr. 23, 2014.

Hao, Ling, "Sealing: Enhance Anodic Coatings' Performance," Metalast Technical Reports, 2001, pp. 1-19.

Hsu, Pa Ho, and Bates, T. F. "Formation of X-ray amorphous and crystalline aluminum hydroxides" Mineral Mag. (1964) vol. 33 pp. 749-768.

Lu, W., et al., "Electrically Controlling Infiltration Pressure in Nanopores of a Hexagonal Mesoporous Silica," Materials Chemistry and Physics 133 (2012), pp. 259-262.

Meyer et al, "Synthesis and dispersion of Ni(OH)2 platelet-like nanoparticles in water" Journal of Colloid and Interface Science (2004) vol. 277 No. 2 pp. 309-315.

Mowry, S., "Light Alloy Super Cones: The Keronite Story," Multi Media Manufacturer, Mar./Apr. 2007, pp. 14-19.

Palmer, D., et al., "Solubility of Nickel Oxide and Hydroxide in Water," Chemical Sciences Division, Oak Ridge National Laboratory, 6 pages.

Pinner, Wernick, and Sheasby, P.G., "Surface Treatment and Finishing of Aluminum and Its Alloys," Chapter 6, pp. 291-354, 4th Ed, vol. 1, 1972.

Poinern, G. et al., "Progress in Nano-Engineered Anodic Aluminum Oxide Membrane Development," Materials 2011, 4, Feb. 25, 2011, pp. 487-526.

Runge, J. et al., White Paper-Sanford Process, Date is unknown.

Sato, T., et al., "Technical Applications & Theoretical Backgrounds of Secondary Electrolysis Anodized Aluminum," Proceedings of the AESF Annual Technical Conference: 82; 1995, pp. 367-392.

Somiya and Roy, "Hydrothermal synthesis of fine oxide powders" Bull. Mater. Sci. (2000) vol. 23 No. 6 pp. 453-460.

Sulka, Grzegorz D., "Highly Ordered Anodic Porous Alumina Formation by Self-Organized Anodizing," Nanostructured Materials in Electrochemistry, 2008, pp. 1-116.

Sulka, Grzegorz D., "Nanostructured Materials in Electrochemistry," Chapter 1, pp. 1-116, Ali Eftekhari, John Wiley & Sons, Mar. 2008.

Violante and Huang, "Formation Mechanism of Aluminum Hydroxide Polymorphs" Clays and Clay Minerals (1993) vol. 41 No. 5 pp. 590-597.

Wernick, S., et al., "The Surface Treatment and Finishing of Aluminium and Its Alloys including the Production of Aluminium Coatings for Protection," Fourth Edition, vol. 1, Robert Draper Ltd., Teddington 1972, p. 303.

Ye, Kuo-Yu, "The Effect of Aluminum Heat Treatment on the Growth of Aluminum Oxide Film," Thesis for Master of Science Department of Chemical Engineering, Tatung University, Jul. 2005, 90 pages.

Extended European Search Report for application No. EP11784037.1 dated Jul. 25, 2017.

Zemanova et al., "Combination of Sealing Methods on Anodised Aluminium", Galvanotechnik, Leuze Verlag, vol. 97, No. 5, pp. 1100-1103, May 1, 2006.

Yaffe, B., "Sealing of Anodized Aluminum-A Review", Metal Finishing: Devoted Exclusively to Metallic Surface Treatments, Elsevier, vol. 88, No. 5, pp. 41-45, May 1, 1990.

* cited by examiner

| | | | | | |
|---|---|---|---|---|---|
| Faded | 100-50 | 100 is no fading, <50 is an automatic fail | | | |
| | | | | | |
| Grey Scale | | | | | |
| | | 100 | | | |
| | | | | | |
| | | 85 | | | |
| | | | | | |
| | | 75 | | | |
| | | | | | |
| | | 65 | | | |
| | | | | | |
| | | 50 | | | |
| | | | | | |

FIG. 12

MICROCRYSTALLINE ANODIC COATINGS AND RELATED METHODS THEREFOR

CROSS-REFERENCE TO RELATED APPLICATION

This application is a continuation-in-part application of and claims the benefit of priority under 35 U.S.C. § 120 of U.S. patent application Ser. No. 14/105,049 filed on Dec. 12, 2013 which, in turn, is a divisional of and claims priority under 35 U.S.C. § 120 to U.S. patent application Ser. No. 12/783,130 filed on May 19, 2010, now U.S. Pat. No. 8,609,254, titled MICROCRYSTALLINE ANODIC COATINGS AND RELATED METHODS THEREFORE. Each of these applications is hereby incorporated herein by reference in its entirety for all purposes.

BACKGROUND OF INVENTION

1. Field of Invention

This invention relates to coatings on metals and related methods therefore and, in particular, to coatings such as anodized coatings on metal and metal alloys that exhibit resistance to steam, including superheated steam, and resistance to alkaline and acidic degradation.

2. Discussion of Related Art

Anodic coatings for aluminum and aluminum alloys, for example, are typically classified by type and class. Type I coatings are derived from chromic acid electrolyte and type IB coatings from low voltage processes in chromic acid electrolyte. Type IC coatings are typically produced by non-chromic acid anodizing. Type II coatings are produced in a sulfuric acid electrolyte. Type III coatings, also referred to as hard anodic coatings, are also produced in a sulfuric acid electrolyte. Class 1 coatings are dye free coatings and class 2 coatings are dyed coatings.

Type II and Type III are characterized as having significant porosity by the nature of the cell formation and coatings can be left unsealed or can be sealed. Sealing of anodic coatings on metal surfaces can be classified based on the composition of the seal solution, based on the operating temperature, or based on the mechanism of the process.

Traditional sealing processes can be considered to include hot (boiling) deionized water sealing, steam sealing, sodium or potassium dichromate sealing, sodium silicate sealing, nickel acetate sealing, nickel fluoride sealing, and new sealing processes, such as cobalt acetate sealing, trivalent chromium sulfate or acetate sealing, cerium acetate sealing, zirconium acetate sealing, triethanolamine-based sealing, lithium or magnesium salt-based sealing, potassium permanganate sealing, polymer-based sealing, and oxidizing corrosion inhibitor-based sealing such as those involving molybdate, vanadate, tungstate, and perborate agents.

Sealing processes based on temperature can involve high temperature sealing (above 95° C.) with steam, hot water, and dichromate; mid-temperature sealing (80° C.-95° C.) with silicate and divalent or trivalent metal acetates, triethanolamine-based techniques, and oxidizing corrosion inhibitor based techniques; low temperature sealing (70° C.-80° C.) with metal acetate, and ambient temperature sealing (25° C.-35° C.) with nickel fluoride.

Sealing processes can also be classified by sealing mechanism as by hydrothermal sealing which typically involves converting aluminum oxide to boehmite (aluminum oxide hydroxide, AlO(OH)); physical or chemical impregnation and filling of the micropores of the anodic layer by dichromate, silicate, nickel fluoride, and polymer compounds; electrochemical sealing which involves electrophoretic migration and deposition anionic species in the micropores; and corrosion inhibition sealing which involves thermal motion and diffusion promoted absorption of corrosion inhibitors into the micropores.

Sealing of type I, IB, IC, II, IIB and III coatings can be performed by immersion in aqueous dichromate solutions with a pH of 5-6 and a temperature of 90° C.-100° C. for 15 minutes, by immersion in boiling deionized water, or by immersion in a cobalt acetate solution or a nickel acetate solution. Sealing can also be performed by immersion in a sealing medium of hot aqueous nickel acetate or cobalt acetate with a pH of 5.5-5.8 or by immersion in boiling deionized water. Duplex sealing with hot aqueous solutions of nickel acetate and sodium dichromate can also be performed on type I, IB, IC, II, IIB, and III coatings. In accordance with MIL-A-8625, type III coatings for abrasion or resistance service are typically not sealed. Otherwise, type III coatings can be sealed by immersion in boiling deionized water, in a hot aqueous sodium dichromate solution, or in hot aqueous solution of nickel acetate or cobalt acetate and other sealing mechanisms.

Smutting can be encountered in sealing processes, typically during hydrothermal sealing procedures. Smutting can result from the conversion of the coating surface to boehmite.

Smutting is typically associated with high operational temperature and pH, long immersion time, aged sealing solution containing too much dissolved solids and breakdown components of additives, and shortage of anti-smutting agents and/or surface active agents. Anti-smutting agents can inhibit the formation of boehmite on the coating surface without adversely affecting the sealing process within the micropores. Typical anti-smutting agents include, for example, hydroxycarboxylic acids, lignosulphonates, cycloaliphatic or aromatic polycarboxylic acids, naphthalene sulphonic acids, polyacrylic acids, phosphonates, sulphonated phenol, phosphonocarboxylic acids, polyphosphinocarboxylic acids, phosphonic acids, and triazine derivatives.

As illustrated in FIG. 1, anodic coatings 102 on some nonferrous metals such as aluminum and aluminum alloys 104 can have porous structures with cells including pores or voids 106 or micropores and walls of a metal oxide, and a barrier oxide layer 108. The porous structure can be susceptible to aggressive environments and water absorption, which can result in degradation the anodized layer.

Conventional hydrothermal sealing process is typically performed by immersion or exposure to hot water or steam at temperatures above 80° C. to hydrate the anhydrous oxide ($Al_2O_3$) in anodic coatings to form boehmite-like crystals (AlO(OH)) according to the following reaction:

$$Al_2O_3(\text{anodic coating})+H_2O \rightarrow 2AlO(OH) \quad (1)$$

Because boehmite (3.44 g/cm$^3$) has a larger volume per unit mass than aluminum oxide (3.97 g/cm$^3$) and because two moles of boehmite can be formed from one mole of aluminum oxide, the micropores are eventually at least partially filled, and typically blocked and closed by the resultant expansion of the cell walls of the anodic coating during hydrothermal sealing. Hydrolysable salts and organic agents can be utilized to improve the sealing performance and efficiency, saves energy, and minimizes the formation of smut on the surface of anodic coatings. For example, nickel ions from nickel acetate can catalytically hydrate aluminum oxide to boehmite through the co-precipitation of nickel hydroxide ($Ni(OH)_2$):

$$Ni^{2+}+2OH^- \rightarrow Ni(OH)_2\downarrow \quad (2)$$

In dichromate sealing, aluminum oxydichromate ($AlOHCrO_4$) or aluminum oxychromate ($(AlO)_2CrO_4$) forms in the micropores according to the reactions:

$$Al_2O_3+2HCrO_4^-+H_2O \rightarrow 2AlOHCrO_4^-\downarrow+2OH^- \quad (pH<6.0) \quad (3)$$

$$Al_2O_3+HCrO_4^- \rightarrow (AlO)_2CrO_4^-+OH^- (pH>6.0) \quad (4)$$

In silicate sealing, silicate ions react with aluminum oxide to form aluminum silicate ($Al_2OSiO_4$) in the micropores of an anodic coating according to the following reaction:

$$Al_2O_3+SiO_3^{2-}+H_2O \rightarrow Al_2OSiO_4^-\downarrow+2OH^- \quad (5)$$

The micropores of an anodic coating are not completely filled and closed in either dichromate sealing or silicate sealing. Accordingly, poor results may be anticipated if an acid dissolution test or a dye stain test is used to evaluate the sealing quality. However, dichromate sealing or silicate sealing actually enhances the corrosion resistance of anodic coatings on aluminum, which is ascribed to the role of chromate or silicate in inhibiting the corrosion of aluminum.

Cold sealing processes typically involve nickel fluoride-based sealing techniques. Because cold sealing processes are typically performed at room temperature, reaction (1) does not normally occur in the micropores and voids of an anodic coating. With the catalytic effect of co-precipitation of nickel hydroxide and aluminum fluoride, aluminum oxide is transformed to aluminum hydroxide instead of boehmite at temperatures below 70° C., as expressed in the following reactions:

$$Ni^{2+}+2OH^- \rightarrow Ni(OH)_2^- \quad (2)$$

$$Al_2O_3+6F^-+3H_2O \rightarrow 2AlF_3^-+6OH^- \quad (6)$$

$$Al_2O_3+3H_2O \rightarrow 2Al(OH)_3\downarrow \quad (7)$$

As with dichromate and silicate sealing, cold nickel fluoride sealing is an impregnation process that does not completely fill and close the micropores and voids, despite the approximate 150% increase in volume when $Al_2O_3$ (3.97 g/cm$^3$) is transformed to $Al(OH)_3$ (2.42 g/cm$^3$) in accordance with reaction (7). It is recognized that aluminum hydroxide is chemically less stable and more soluble in aqueous solutions than boehmite. The formed $Al(OH)_3$ tends to be spongy rather than crystalline in form and the sealed anodic article performs poorly when evaluated with acid dissolution or dye stain tests.

Consequently, the anti-corrosion performance of anodized articles post treated by cold sealing can be considered inferior to that treated with conventional hydrothermal sealing and other impregnation processes mentioned above.

SUMMARY OF THE INVENTION

One or more aspects of the invention can relate to a method of producing a metal substrate cells with pores and walls comprising at least one of partially microcrystalline metal oxide and partially microcrystalline metal hydroxide. One or more particular aspects of the invention can relate to a method of producing a metal substrate cells with pores and walls comprising at least one of at least partially microcrystalline metal oxide and at least partially microcrystalline metal hydroxide. One or more further aspects of the invention can be directed to a method of producing an anodized aluminum substrate cells with pores and walls at least partially comprising at least one of microcrystalline aluminum oxide and microcrystalline aluminum hydroxide. Some aspects of the invention can be directed to a method of producing an anodized aluminum substrate having structures of at least one of partially microcrystalline aluminum oxide and partially microcrystalline aluminum hydroxide from an aluminum substrate having cells with micropores and walls of at least one of amorphous aluminum oxide and amorphous aluminum hydroxide comprising introducing a metal cationic species into at least a portion of the micropores, converting at least a portion of the metal cationic species into a metal hydroxide, converting at least a portion of the metal hydroxide into a metal oxide, and converting at least a portion of the walls of at least one of amorphous aluminum oxide and amorphous aluminum hydroxide into structures of at least one of partially microcrystalline aluminum oxide and partially microcrystalline aluminum hydroxide. The method can comprise introducing a metal cationic species into at least a portion of the micropores; converting at least a portion of the metal cationic species into a metal hydroxide; converting at least a portion of the metal hydroxide into a metal oxide; and converting at least a portion of walls of the micropores of at least one of amorphous aluminum oxide and amorphous aluminum hydroxide into at least partially comprising at least one of partially microcrystalline aluminum oxide and partially microcrystalline aluminum hydroxide. In one or more embodiments related to such methods, converting at least a portion of walls of the micropores can comprise immersing the aluminum substrate in an aqueous metal salt solution having a temperature in a range of from about 75° C. to about 95° C. to convert at least a portion of at least one of the amorphous oxide and amorphous hydroxide into at least one of partially microcrystalline aluminum oxide and partially microcrystalline aluminum hydroxide. The aqueous metal salt solution can comprise at least one of metal acetate and a metal nitrate. In one or more other embodiments related to such methods, converting at least a portion of the metal hydroxide can comprise heating, for example, the aluminum substrate in an oxidizing atmosphere at a temperature in a range of from about 150° C. to about 300° C. for an oxidizing period of at least about 30 minutes. In one or more further embodiments related to such methods, converting at least a portion of the metal cationic species comprises immersing the metal substrate in an alkaline solution having a pH of at least about 8 units. In one or more further embodiments related to such methods, introducing the metal cationic species into the at least a portion of the micropores comprises immersing the aluminum substrate in an aqueous metal solution comprising a metal fluoride and a surfactant. In one or more still further embodiments related to such methods, introducing the metal cationic species into the at least a portion of the micropores comprises exposing the aluminum substrate to ultrasonic energy in an ultrasonic bath that is free of fluoride and free of a surfactant.

One or more aspects of the invention can be directed to a method of producing an anodized aluminum substrate. The method can comprise immersing the aluminum substrate in a first aqueous metal salt solution; exposing the aluminum substrate to an alkaline solution having a pH in a range of from about 8 units to about 13 units and ultrasonic energy, after immersing the aluminum substrate in the first aqueous solution; thermally treating the aluminum substrate in an oxidizing atmosphere at a drying temperature of at least about 150° C. after immersing the aluminum substrate in the alkaline solution; and immersing the aluminum substrate in a second aqueous metal solution having a temperature in a range of from about 75° C. to about 95° C. after thermally treating the aluminum substrate. In accordance with one or more aspects of the invention, the first aqueous metal salt solution comprises a fluoride of at least one of nickel, iron, zinc, copper, magnesium, titanium, zirconium, aluminum, and silver. In accordance with one or more aspects of the invention, the first aqueous metal salt solution can have a pH of less than about 7 units and a temperature in a range of from about 15° C. to about 35° C. In accordance with one or more aspects of the invention, the first aqueous metal salt solution can comprise less than about 100 ppm of a surfactant and, in some cases, the first aqueous metal salt solution can comprise about 0.5 wt % to about 8.0 wt % of metal cationic species. In accordance with one or more aspects of the invention, exposing the aluminum substrate comprises immersing the aluminum substrate in an alkaline solution comprising an alkali metal hydroxide such as sodium hydroxide and potassium hydroxide (NaOH and KOH) and a surfactant for a period in a range of from about 1 minute to about 5 minutes. In some cases, the alkaline solution having a temperature in a range of from about 20° C. to about 60° C. In accordance with one or more aspects of the invention, exposing the aluminum substrate can comprise directing ultrasonic energy to the substrate, typically in an ultrasonic bath for a period in a range of from about 10 minutes to about 25 minutes. In accordance with one or more further aspects of the invention, thermally treating the aluminum substrate can comprise heating the aluminum substrate in an oven at a temperature in a range of from about 150° C. to about 300° C., typically for a period of from about 30 minutes to about two hours. In some cases, the second aqueous metal solution has a pH in a range of from about 5.0 units to about 6.0 units and, in still further cases, the solution can comprise at least one of a metal acetate and a metal nitrate in a concentration of from about 4.5 wt % to about 6.5 wt %.

One or more aspects of the invention can be directed to an aluminum article comprising an anodized coating of at least about 0.05 mm having a Taber abrasion loss of less than about 109 mg as determined in accordance with ASTM 4060 after immersion in a sodium hydroxide solution at least about 0.04 wt % for 11 days at a temperature in a range of from about 15° C. to about 25° C.

One or more aspects of the invention can be directed to an aluminum article comprising a dyed anodized coating of at least about 0.05 mm having a fading that of less than a $\Delta L^*$ of about 1.5, a $\Delta a^*$ of about 2.0, and $\Delta b^*$ of about 2.5 values in accordance with a CIE (Commission Internationale d'Eclairage) 1976 L*,a*,b* color scale as performed in accordance with ASTM E 308, after exposure, for at least 5 cycles, to ultrasonic cleaning with a solution having a pH of 12 and to autoclaving at 275° F. In some cases, the ultrasonic cleaning is performed for at least about 45 minutes and, in still further cases, autoclaving is performed for at least about 45 minutes.

One or more aspects of the invention can be directed to an aluminum article comprising an anodized metal coating of at least about 0.05 mm that is partially microcrystalline and having an X-ray diffraction (XRD) spectrum as illustrated in FIG. 7. In some particular cases, the spectrum of the partially microcrystalline coating exhibits peaks at about 18°, 37°, 44°, and 62°.

One or more aspects of the invention can be directed to a method of coating an anodized aluminum substrate. The method may comprise immersing the anodized aluminum substrate in a first aqueous metal salt solution comprising at least one metal cationic species for a first predetermined length of time to form a partially impregnated aluminum substrate, immersing the partially impregnated aluminum substrate in an alkaline solution for a second predetermined length of time to form a fully impregnated aluminum substrate, and immersing the fully impregnated aluminum substrate in a second aqueous metal salt solution comprising at least one metal acetate and having a pH in a range of from about 5 units to about 6 units for a third predetermined length of time to form a coated anodized aluminum substrate.

According to some aspects, the first predetermined length of time is less than 30 minutes. According to another aspect, the concentration of metal cationic species in the first aqueous metal salt solution is from about 0.5 to about 1.0 wt %. According to a further aspect, the metal cationic species is selected from the group consisting of nickel, iron, zinc, copper, magnesium, titanium, zirconium, and mixtures thereof. According to another aspect, the first aqueous metal salt solution further comprises a surfactant. According to a further aspect, the metal cationic species is a fluoride of at least one of nickel, iron, zinc, copper, magnesium, titanium and zirconium. According to another aspect, immersing the anodized aluminum substrate in the first aqueous metal salt solution comprises applying ultrasonic energy. According to another aspect, the concentration of fluoride ion is in a range from about 300 ppm to about 800 ppm.

In accordance with at least one aspect, the alkaline solution further comprises a surfactant at a concentration up to about 200 ppm. According to another aspect, the second predetermined length of time is for a period of from about 3 minutes to about 8 minutes. According to a further aspect, the alkaline solution comprises at least one of sodium hydroxide and potassium hydroxide.

According to another aspect, the third predetermined length of time is for a period of from about 20 minutes to about 45 minutes. According to another aspect, the second aqueous metal salt solution has a temperature in a range of from about 80° C. to about 95° C. According to certain aspects, the at least one metal acetate comprises at least one of nickel acetate, magnesium acetate, titanium acetate, and zirconium acetate. According to a further aspect, the concentration of the at least one metal acetate in the second aqueous metal salt solution is from about 4.5 wt % to about 6.5 wt %.

In accordance with some aspects, the method further comprises thermally treating the fully impregnated aluminum substrate in an oxidizing atmosphere at a temperature in a range of from about 110° C. to about 350° C. for a period of at least about 20 minutes. According to another aspect, thermally treating the fully impregnated anodized aluminum substrate comprises heating the fully impregnated anodized aluminum substrate at a temperature in a range of from about 135° C. to about 300° C. for a period of at least about 30 minutes. In accordance with certain aspects, the fully impregnated anodized aluminum substrate is thermally treated prior to immersing in the second aqueous metal salt solution.

According to another aspect, the method further comprises subjecting the coated anodized aluminum substrate to a hydrothermal synthesis process. According to a further aspect, the hydrothermal synthesis process comprises heating the anodized aluminum substrate in a chamber at a temperature of at least 110° C. and a pressure of at least 15 psi for a period of between about 20 minutes to about five hours.

One or more aspects of the invention can be directed to an aluminum article. The aluminum article may comprise an anodized coating with a thickness of at least about 0.01 mm, wherein the anodized coating is dyed and has a fading of less than ΔL* of about 1.5, Δa* of about 2.0, and Δb* of about 2.5 values in accordance with a CIE (Commission Internationale d'Eclairage) 1976 L*, a*, b* color scale as performed in accordance with ASTM E 308, after exposure, for at least one cycle of a sterilization process.

According to certain aspects, the at least one cycle is at least 300 cycles. According to another aspect, the sterilization process is a hydrogen peroxide sterilization process. According to a further aspect, each cycle includes 25 minutes of diffusion and 15 minutes of exposure to a hydrogen peroxide derived gas plasma. According to another aspect, the anodized coating is organically dyed.

BRIEF DESCRIPTION OF THE DRAWINGS

The accompanying drawings are not intended to be drawn to scale. In the drawings, each identical or nearly identical component or step that is illustrated in various figures is represented by a like numeral. For purposes of clarity, not every component or step may be labeled in every drawing. In the drawings:

FIG. 12 is a chart for rating fading of samples treated in accordance with an example disclosed herein.

DETAILED DESCRIPTION

Figure 1:
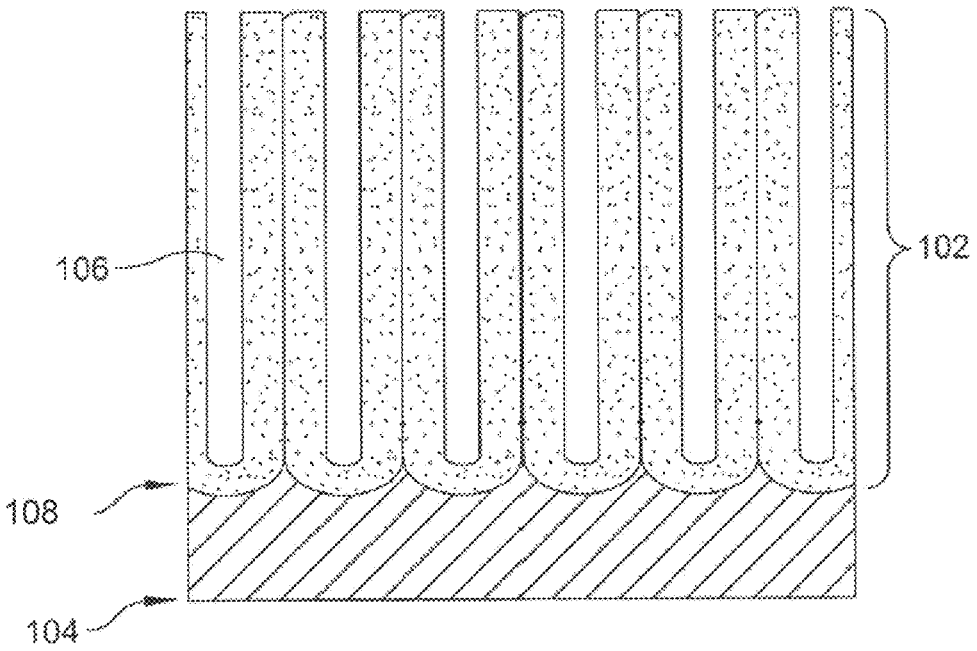
FIG. 1 is a schematic illustration showing an anodic coating for conversion or sealing thereof in accordance with one or more aspects of the present invention.
Figure 2:
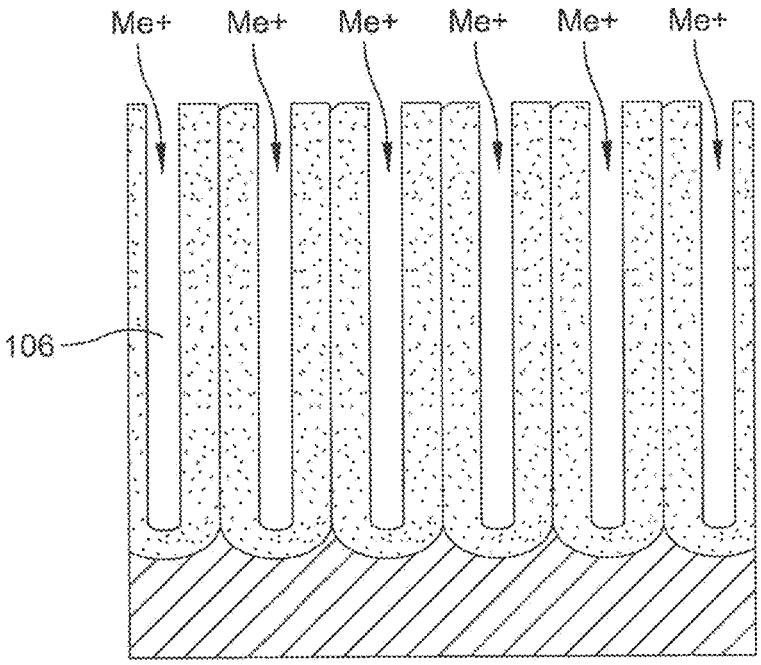
FIG. 2 is a schematic illustration showing introduction of metal precursor species an anodic coating for conversion or sealing thereof in accordance with one or more aspects of the present invention.
Figure 3:
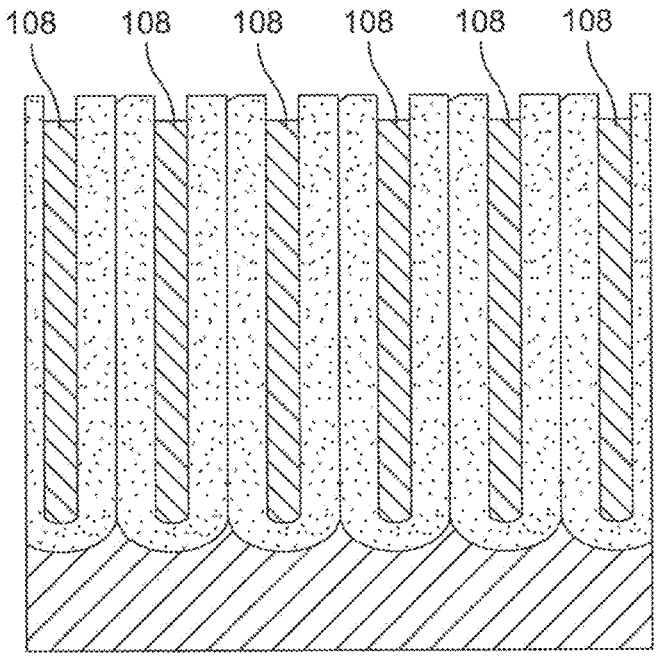
FIG. 3 is a schematic illustration showing conversion of the metal precursor species into an intermediate compound in an anodic coating for conversion or sealing thereof in accordance with one or more aspects of the present invention.

One or more aspects of the present invention can be directed to treatments that provide anodic coatings on metal substrates with desirable physical and chemical properties. One or more aspects of the invention can be directed to articles having at least partially microcrystalline anodic coatings thereon. Further aspects of the invention can be directed to techniques of producing a metal substrate having structures comprising at least one of partially microcrystalline metal oxide and partially microcrystalline metal hydroxide. Still further aspects of the invention can be directed to techniques of producing metal substrates having structures comprising at least one of at least partially microcrystalline metal oxide and at least partially microcrystalline metal hydroxide. Some aspects of the invention can be directed to fabricating anodized aluminum articles having microcrystalline features of at least one of microcrystalline aluminum oxide and microcrystalline aluminum hydroxide from aluminum articles having anodized coatings with cells defined by micropores and walls of any of amorphous aluminum oxide and aluminum hydroxide by introducing at least one metal cationic species into at least a portion of the micropores, converting at least a portion of the metal cationic species into a metal hydroxide, converting at least a portion of the metal hydroxide into a metal oxide, and converting at least a portion of the cells of at least one of amorphous aluminum oxide and amorphous aluminum hydroxide to fabricate the aluminum articles having partially microcrystalline feature of at least one of microcrystalline aluminum oxide and microcrystalline aluminum hydroxide.

One or more aspects of the invention can relate to techniques of producing an anodized aluminum substrate having structures that are preferably comprised of at least one of microcrystalline aluminum oxide and microcrystalline aluminum hydroxide, more preferably, at least one or partially microcrystalline aluminum oxide and partially microcrystalline aluminum hydroxide. One or more further aspects of the invention can involve promoting crystallinity of an anodic layer on a substrate. One or more still further aspects of the invention can be directed to techniques of producing an anodized aluminum substrate. The partially microcrystalline anodic coated articles pertinent to some aspects of the invention can be utilized in a variety of applications such as but not limited to tools including consumer hardware, trade equipment; equipment and machinery parts including those for semiconductor, oil and mineral extraction, and other industrial processes; medical devices and equipment including general medical and orthopedic equipment such as containers, trays, modules, handles, fixturing devices, carts; automotive components including exterior trim, engine and transmission parts, such as pistons, rings, valves; naval and marine components such as propellers, outdrives, cleats, winches, locks, masts, rigging, and other wetted components; electronic housing; aerospace parts and equipment; military parts and equipment including gun parts, night vision systems, electronic equipment, transportation equipment; household and commercial appliances such as dishwashers, driers, clothes washers, sinks; construction equipment and hardware such as bathroom and kitchen hardware; and cooking apparatus utensils, and equipment such as cookware, tableware for domestic and commercial use.

Some aspects of the invention can be directed to sealing that can at least partially fill the voids or spaces of the cells such as micropores 106 by, for example, impregnation or filling with a barrier material that provides at least partial protection of the underlying material from degradation of a metal as exemplarily illustrated in FIGS. 2-5.

Micropores 106 can at least be partially impregnated or filled by introducing one or more compounds that is at least partially resistant to acidic attack or alkaline attack under various conditions. In accordance with one or more embodiments of the invention, the one or more compounds can be introduced into micropores 106 by immersion of the metal substrate in a bath containing one or more precursor compounds under conditions that are non-reactive to the substrate metal or substrate metal oxide. Thus, in some cases, for example, one or more aspects of the invention can involve introducing one or more metal cationic species into at least a portion of the spaces or voids of a metal substrate, such as micropores 106. In accordance with some embodiments of the invention, the metal substrate, such as an aluminum substrate or an aluminum alloy substrate, can be immersed in a first aqueous metal salt solution, preferably at ambient conditions. One or more embodiments of the invention can involve introducing one or more metal cationic species into at least a portion of the pores by, for example, immersing the metal substrate in an aqueous metal solution. The metal species or base metal salt in solution can at least partially impregnate at least a portion of the anodic pores by diffusion phenomena as exemplarily illustrated in FIG. 2. According to some embodiments, the metal substrate may be immersed in a first aqueous metal salt solution to form a partially impregnated metal substrate. Non-limiting examples of the metal that can be utilized as a precursor compound include nickel, iron, zinc, copper, magnesium, titanium, zirconium, aluminum, and silver. For example, according to certain aspects, the bath or aqueous metal solution may comprise one or more of nickel, iron, zinc, copper, magnesium, titanium, and zirconium. For instance, according to some embodiments, the bath or aqueous metal solution may comprise at least one metal cationic species. According to one embodiment, the metal cationic species may be selected from the group consisting of nickel, iron, zinc, copper, magnesium, titanium, zirconium, and mixtures thereof. The bath or aqueous metal solution can have a pH of less than about 7 units and a temperature in a range of from about 15° C. to about 35° C. According to some embodiments, the bath or aqueous metal solution may have a pH in a range from 5 to 7, and in at least one embodiment, the pH may be in a range from 5.8 to 6.2. According to certain embodiments, the metal substrate may be immersed in the aqueous metal solution for a predetermined length of time. The predetermined length of time may be sufficient for metal cationic species to be introduced into at least a portion of the pores. In some embodiments, the predetermined length of time may be from about 5 minutes to about 60 minutes. In some embodiments the predetermined length of time may be from about 10 minutes to about 25 minutes. According to some embodiment, the predetermined length of time may be from and in certain instances may be less than 30 minutes. In accordance with one or more aspects of the invention, the first aqueous metal salt solution can comprise less than about 100 ppm of a surfactant and, in some cases, the bath or first aqueous metal salt solution can comprise, consist of, or consists essentially of about 0.5 to about 8.0 wt % of metal cationic species. In accordance with some embodiments, the first aqueous metal salt solution may comprise metal cationic species in a range of 0.5 to about 1.0 wt %, and in at least one embodiment, may comprise metal cationic species in a range of 0.8 to about 1.0 wt %.

In accordance with some advantageous conditions, the aqueous metal solution further comprises at least one surfactant. In some further advantageous configurations, the aqueous metal solution can be a bath containing a fluoride. Thus, in some cases, the aqueous metal solution can comprise a fluoride of at least one of nickel, iron, zinc, copper, magnesium, titanium, zirconium, aluminum, and silver, with or without a surfactant. In such instances, at least a portion of the aluminum oxide of walls of micropores 106 can react with the fluoride anionic species to form aluminum fluoride, typically at least a portion of the inside surfaces of the micropores (not shown). In a variant thereof, the aqueous metal solution can consist essentially of a fluoride of at least one of nickel, iron, zinc, copper, magnesium, titanium, zirconium, aluminum, and silver, with at least one surfactant. In another variant thereof, the aqueous metal solution can consist essentially of a fluoride of at least one of nickel, iron, zinc, copper, magnesium, titanium, zirconium, aluminum, and silver, without a surfactant. According to some embodiments, the concentration of fluoride ion in the aqueous metal salt solution is in a range from about 300 to 800 ppm. According to some embodiments, the concentration of fluoride ion in the aqueous metal salt solution may be in a range from about 400 to 700 ppm. According to one embodiment, the concentration of fluoride ion in the aqueous metal salt solution may be in a range from about 500 ppm to about 650 ppm.

In one or more further variants in accordance with one or more such aspects of the invention, introducing the metal cationic species into the at least a portion of the pores can comprise exposing the metal or metal alloy substrate to ultrasonic energy in an ultrasonic bath that is free of fluoride and free of a surfactant. According to various aspects, the ultrasonic energy promotes a reaction between dissolved fluoride ion (if used) and aluminum oxide by generating strong oxidizing agents such as hydroxyl radicals, hydroxide ions, and hydrogen peroxide.

Some further aspects of the invention can involve converting at least a portion of the precursor compound, such as the metal cationic species, into a stable metal compound. For example, at least a portion of the metal cationic species can be converted or reacted to form metal hydroxide. In some cases, the metal precursor can be induced to form a precipitate 108 and preferably fill, at least partially, micropores 106, as exemplarily illustrated in FIG. 3, as, for example, the metal hydroxide. Converting at least a portion of the metal cationic species can comprise immersing, at least partially, the metal or metal alloy substrate in an alkaline solution having a pH of at least about 8 units. Thus, according to at least one embodiment, the partially impregnated metal substrate formed from immersing the metal substrate in the first aqueous metal salt solution may be immersed in an alkaline solution to form a fully impregnated metal substrate. Formation or conversion into the metal hydroxide can involve exposing the aluminum substrate to an alkaline solution having a pH in a range of from about 8 units to about 13 units. In a variant thereof, the metal or metal alloy, or at least a portion thereof, can be exposed to ultrasonic energy, after immersing the aluminum substrate in the first aqueous solution. In accordance with one or more aspects of the invention, exposing the metal or metal alloy substrate can comprise immersing the substrate in an alkaline solution comprising an alkali metal hydroxide or an alkali earth hydroxide and one or more surfactants for a period sufficient to convert at least a portion of the metal cationic species into a metal hydroxide. For example, conversion can involve immersion of the metal substrate for a period in a range of from about 1 minute to about 5 minutes. The alkaline solution can consist essentially of an alkali metal hydroxide and a surfactant but in other cases, the alkaline solution can consist essentially of an alkali earth hydroxide and in yet other cases, the alkaline solution can consist essentially of a mixture of an alkali metal hydroxide and an alkaline earth hydroxide. According to some embodiments, the alkaline solution may comprise at least one of sodium hydroxide and potassium hydroxide. Thus, the hydroxide ions from the sodium hydroxide and/or potassium hydroxide may react with the metal cationic species introduced into the micropores during the first aqueous metal bath step to form at least one of a nickel hydroxide, iron hydroxide, copper hydroxide, zinc hydroxide, magnesium hydroxide, titanium hydroxide, and zirconium hydroxide precipitates. Without being bound by theory, it is hypothesized that up to half of the pore filling is completed during this step; in some instances it is believed that about 20-50% of pore filling is completed during this step. It is also hypothesized that actual precipitation commences at an alkaline pH that may be determined specifically by the metal cationic species being precipitated. For example, in some embodiments, actual precipitation commences when the pH of the inside of the pore reaches about 8.0. According to some embodiments, this process may take less than 10 minutes, and in some instances may be less than 8 minutes. According to some embodiments, the metal or metal alloy substrate may be immersed in the alkaline solution for approximately 3-5 minutes. The alkaline solution preferably has a temperature in a range of from about 20° C. to about 60° C. In accordance with at least one embodiment, the alkaline solution may have a pH of 10-12, and in certain instances may have a pH of 10.5-11.5, or in the alternative, may be prepared such that a ratio of metal hydroxide, such as sodium hydroxide, to aluminum is from 3.0-3.3. The alkaline solution may thus facilitate the conversion of non-crystalline materials and poorly ordered intermediate aluminum species to crystalline aluminum hydroxide and metal hydroxides.

In accordance with some embodiments, the alkaline solution further comprises at least one surfactant. The surfactant may be added to the alkaline solution at a concentration sufficient to lower the interfacial tension between the alkaline solution and the metal or metal alloy substrate. For example, the alkaline solution may comprise a surfactant at a concentration up to about 200 ppm of surfactant, and in some embodiments, may comprise a surfactant at a concentration up to about 100 ppm.

In alternative or complementary cases in accordance with one or more further aspects of the invention (not shown), exposing the metal or metal alloy substrate can comprise directing ultrasonic energy to the substrate in an ultrasonic bath for a period sufficient to convert at least a portion, typically a predefined portion of the metal cationic species into a metal hydroxide. For example, the ultrasonic energy can be directed by immersion of the substrate for a period in a range of from about 10 minutes to about 25 minutes.

Figure 4:
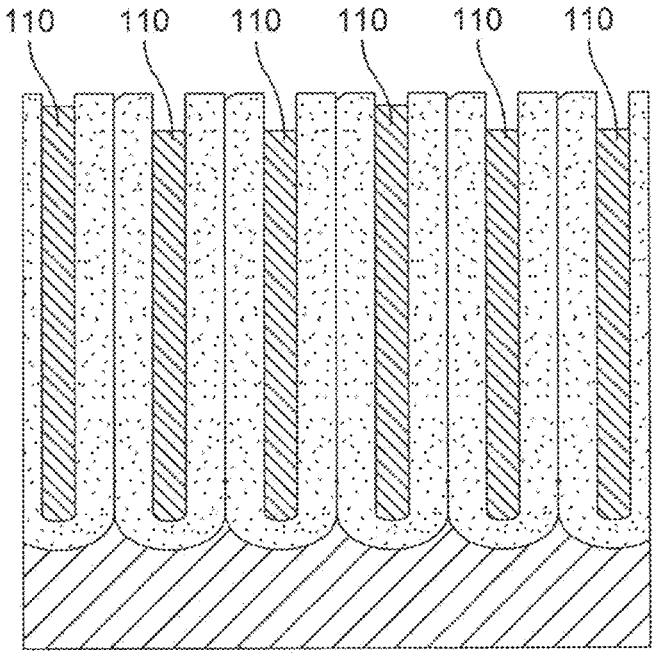
FIG. 4 is a schematic illustration showing conversion of the intermediate compound into metastable species in an anodic coating for conversion or sealing thereof in accordance with one or more aspects of the present invention.

One or more aspects of the invention can involve a thermal treatment that involves converting at least a portion of the metal hydroxide into a metal oxide. As illustrated in FIG. 4, at least a portion of the precipitated metal hydroxide 108 can be converted into a metastable metal oxide 110 in a portion of at least some of the pores. It is believed that at least a portion of the oxidation product is bonded to the metal oxides of the metal or metal alloy substrate, mechanically, chemically, or both. Conversion of at least a portion of the metal hydroxide precipitate 106 can comprise exposing the metal or metal alloy substrate to conditions that thermodynamically favor at least partial oxidation, and in some cases, dehydration or drying, of the hydroxide precipitate. Conversion and bonding can be effected by heating the metal substrate in an oxidizing atmosphere at a thermodynamic conversion temperature for a predetermined oxidizing period that provide a sufficient conversion yield. Depending on the conversion temperature, metal hydroxide oxidation to the metastable oxide can be performed in the oxidizing atmosphere in less than two hours. For example, conversion can be effected by heating in an oven at a temperature of at least about 150° C., typically in a range of from about 150° C. to about 300° C. for a period of at least about 30 minutes. According to some examples, conversion can be effected by heating in an oven (dry) at a temperature in a range of from 110° C. to about 350° C. for a period of at least 10 minutes. According to other examples, conversion can be effected by heating in an oven at a temperature in a range of from 110° C. to about 350° C. for a period of at least 20 minutes. In some instances, the drying period may be for a period of about 60 minutes. According to another example, conversion can be effected by heating in a dry oven at a temperature in a range of from about 135° C. to about 300° C. for a period of at least 30 minutes.

Figure 5:
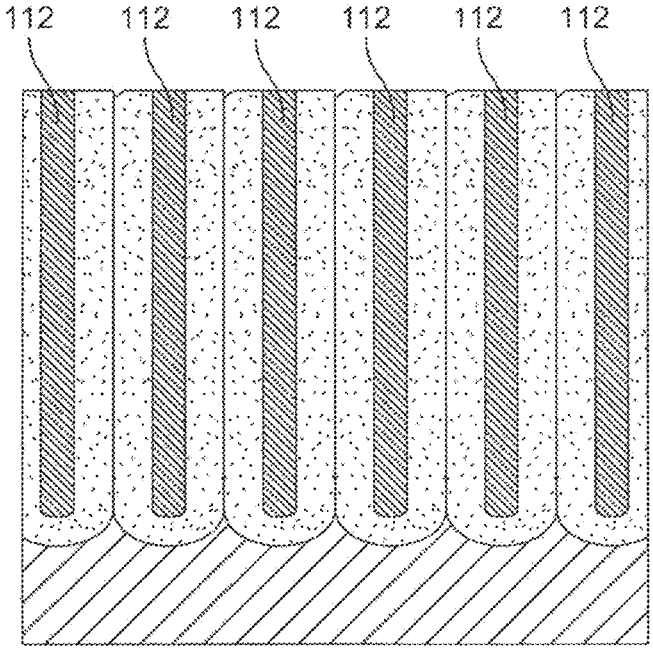
FIG. 5 is a schematic illustration showing conversion of the metastable species into a partially microcrystalline anodic coating in accordance with one or more aspects of the present invention.

One or more further aspects of the invention can involve converting at least a portion of the structure of the micropores, e.g., walls thereof, from an amorphous phase into structures at least partially comprising at least one of partially microcrystalline metal oxide and partially microcrystalline metal hydroxide 112, as exemplarily illustrated in FIG. 5. Conversion can also involve promoting microcrystallinity of at least a portion of the walls of the micropores. Converting at least a portion of the structures can comprise immersing at least a portion of the metal or metal alloy substrate in a second aqueous metal salt solution in conditions that favor conversion into partially microcrystalline metal oxide or partially microcrystalline metal hydroxide phase. For example, conversion to promote microcrystallinity can involve immersion of an aluminum or aluminum alloy substrate in a second aqueous metal solution at a temperature in a range of from about 75° C. to about 95° C. to convert at least one of the amorphous aluminum oxide and/or amorphous aluminum hydroxide thereof into at least one of partially microcrystalline metal oxide and partially microcrystalline metal hydroxide, typically into at least one of partially microcrystalline metal oxide and partially microcrystalline metal hydroxide. The metal or metal alloy substrate may be immersed in the second aqueous metal solution for a period of time sufficient to convert at least one of the amorphous aluminum oxide and/or amorphous aluminum hydroxide into at least one of partially microcrystalline metal oxide and partially microcrystalline metal oxide. For example, according to some embodiments, the metal or metal alloy substrate may be immersed in the second aqueous metal solution for at least 15 minutes, and in some embodiments, may be immersed for less than 60 minutes. According to one embodiment, the metal or metal alloy substrate may be immersed in the second aqueous metal solution for approximately 20 to 45 minutes. The second aqueous metal solution preferably has a pH in a range of from about 5 units to about 6 units and, in some cases, the second aqueous solution can comprise at least one of a metal acetate and a metal nitrate. According to some embodiments, the second aqueous solution may have a pH in a range of from about 5 to about 5.5 units. In some cases, the second aqueous solution can consist essentially of a metal acetate or consist essentially of a metal nitrate. In still other cases, the second aqueous solution can consist essentially of a metal acetate and a metal nitrate. According to some embodiments, the second aqueous solution may comprise at least one metal acetate. In accordance with at least one embodiment, the at least one metal acetate comprises at least one of nickel acetate, magnesium acetate, titanium acetate, and zirconium acetate. The concentration of the metal acetate and/or metal nitrate can be from about 4.5 wt % to about 6.5 wt %. According to one embodiment, the concentration of metal acetate may be from about 4.5 wt % to about 5.5 wt %. Thus in some cases, promoting microcrystallinity can involve partial hydration to form boehmite-like crystals, with associated expansion, to close, at least partially, all or at least a substantial portion of the micropores to form partially microcrystalline structures. In addition, the second aqueous solution may allow aluminum oxide to convert to aluminum oxide hydroxide, which further contributes to closing the micropores. Thus, according to some embodiments, the fully impregnated aluminum substrate formed from immersing the partially impregnated metal substrate in the alkaline solution may be immersed in a second aqueous metal salt solution to form a coated anodized aluminum substrate.

According to some embodiments, a hydrothermal synthesis process using hot water vapor in the form of pressurized steam may be used to convert at least a portion of the metal hydroxide into a metal oxide. For example, the metal hydroxides formed by immersion in the alkaline solution discussed above may be represented as a colloidal gelatin formed within the pore structure, and may be loosely packed, dissolve easily at low pH levels, and leach out during high temperature hydrothermal sealing processes. Therefore, according to at least one embodiment, these metal hydroxides may be transformed into a more stable and solid phase oxide using a hydrothermal synthesis process. Conversion of at least a portion of the metal hydroxide precipitate can comprise exposing the metal or metal alloy substrate to pressurized steam that enters the pore openings. Hydrothermal synthesis differs from steam sealing in that steam sealing is typically performed at temperatures near the boiling point of water and at atmospheric pressures, whereas hydrothermal synthesis occurs at much higher temperatures and pressures. For example, according to some embodiments, conversion and bonding (of at least a portion of the oxidation product) can be effected by heating the metal substrate in a wet, high temperature, high pressure chamber at a temperature. For instance, the metal substrate may be heated in a chamber at a temperature of at least 110° C., and a pressure of at least 15 psi for a period of at least 20 minutes. For example, according to some embodiments, the metal substrate may be heated in a chamber at a temperature of at least 120° C. and a pressure of at least 15 psi for a period of at least 20 minutes to five hours. According to one embodiment, the metal substrate may be heated in a chamber from a temperature of about 120° C. with an autogenous pressure of about 15 psi, to a temperature of about 150° C. with an autogenous pressure of about 70 psi for a period of at least 20 minutes to five hours. In accordance with some embodiments, metal substrate may be heated in the chamber at temperatures exceeding 200° C., including at least 300° C., at least 400° C., and at least 500° C. Suitable chambers include wet, high temperature, high pressure chambers that may be available from Tuttnauer.

According to some embodiments, the hydrothermal synthesis process may be performed after immersing the metal or metal alloy substrate in the second aqueous metal solution. In accordance with various aspects, the hydrothermal synthesis may be performed in lieu of the dry thermal treatment discussed above. For instance, instead of performing a dry thermal heating step after immersion in the alkaline solution, immersion in a second aqueous metal solution may be performed, which may then be followed by hydrothermal synthesis. According to other embodiments, both the dry thermal treatment and the hydrothermal synthesis step may be performed. For example, the dry thermal treatment may be performed after immersion in the alkaline solution, and hydrothermal synthesis may be performed after immersion in the second aqueous metal solution.

Non-limiting example of a surfactant that can be utilized in the various embodiments of the invention include non-ionic surfactants such as but not limited to hydrophilic polyethylene oxide, e.g., polyethylene glycol p-(1,1,3,3-tetramethylbutyl)-phenyl ether, which is commercially available as TRITON™ X-100 surfactant, from The Dow Chemical Company, Midland, Mich.

Figure 6:
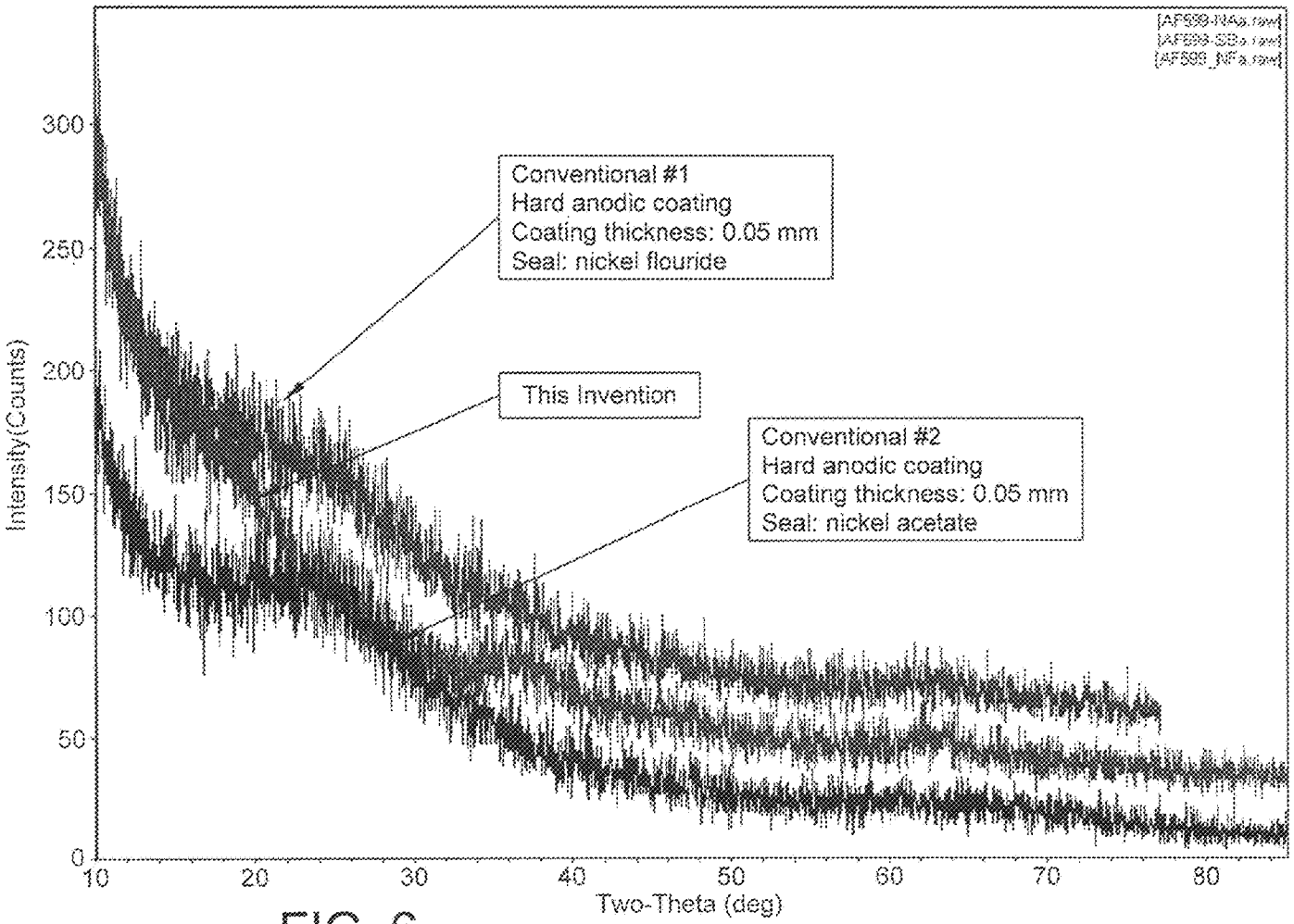
FIG. 6 is a copy of a spectrum of an X-ray diffraction pattern of a partially microcrystalline anodic coating on an aluminum substrate in accordance with one or more embodiments of the present invention, along with conventional amorphous anodic coatings on aluminum substrates.
Figure 7:
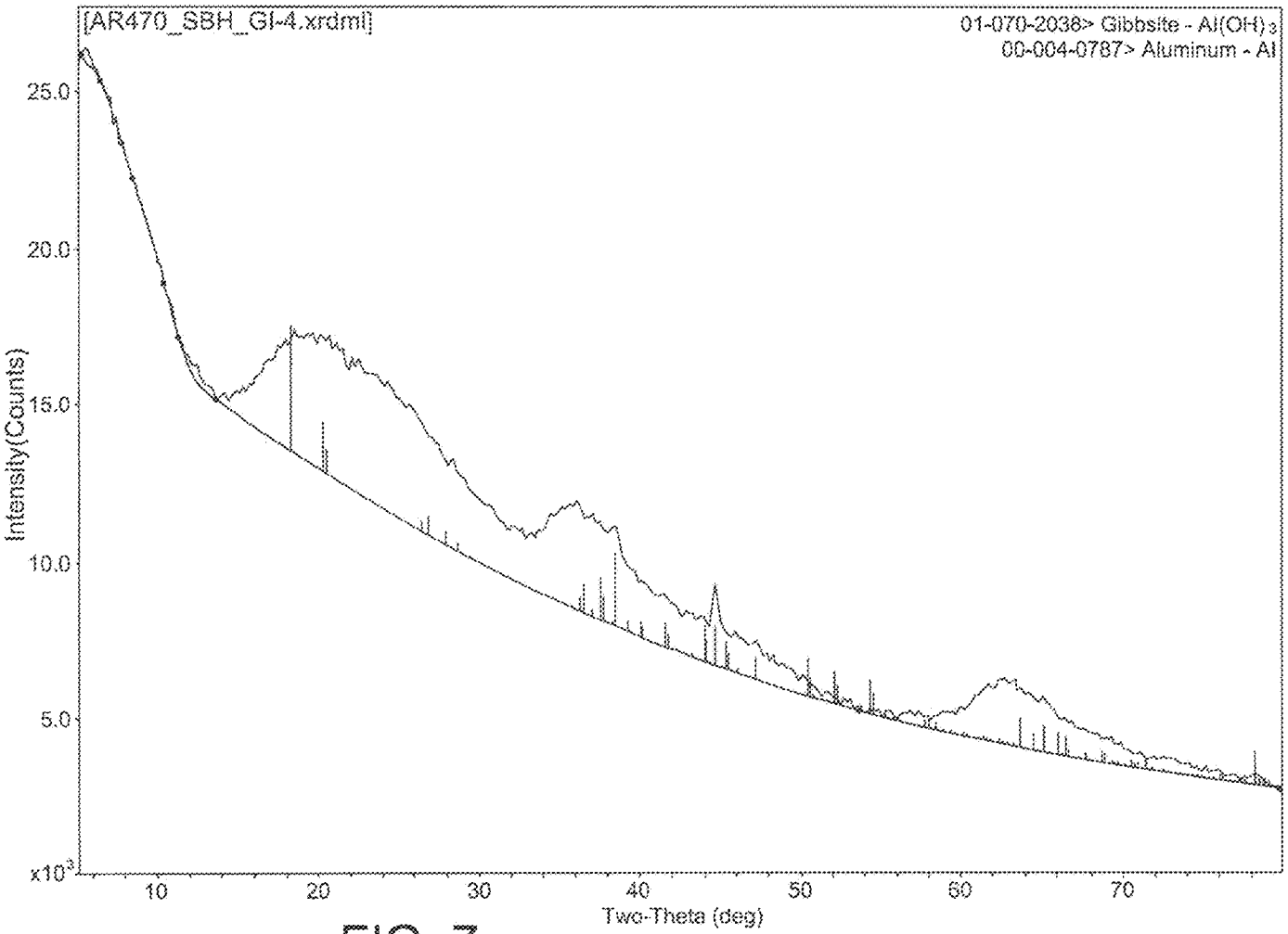
FIG. 7 is a copy of a spectrum of an X-ray diffraction pattern of a partially microcrystalline anodic coating on an aluminum substrate in accordance with one or more embodiments of the present invention.

In embodiments of the invention involving an aluminum or aluminum alloy substrate, the resultant partially microcrystalline anodic coating thereof can be analytically characterized to have an X-ray diffraction pattern or spectrum as illustrated in FIGS. 6 and 7. The spectra presented at FIGS. 6 and 7 show two different XRD incident angles fixed at 1 and 4, respectively. In the spectra, the partially microcrystalline anodic coating, designated as "This Invention" in FIG. 6, exhibit partial microcrystalline character compared to the prior art amorphous, non-crystalline anodic coatings, designated as "Conventional #1" and "Conventional #2." In particular, partially microcrystalline aluminum hydroxide can be noted by the peaks at about 18°, 37°, 44°, and 62°.

One or more aspects of the invention can be directed to an aluminum article comprising a partially microcrystalline coating of at least about 0.01 mm, and in certain instances at least about 0.05 mm, having a Taber abrasion loss of less than about 109 mg as determined in accordance with ASTM 4060 after immersion in a sodium hydroxide solution at least about 0.04 wt % for 11 days at a temperature in a range of from about 15° C. to about 25° C. Further aspects of the invention can be directed to an aluminum article comprising a dyed anodized coating of at least about 0.01 mm, and in certain instances, at least about 0.05 mm, having a fading that of less than $\Delta L^*$ of about 1.5, $\Delta a^*$ of about 2.0, and $\Delta b^*$ of about 2.5 values in accordance with a CIE (Commission Internationale d'Eclairage) 1976 L*,a*,b* color scale as performed in accordance with ASTM E 308, after exposure, for at least 5 cycles, to ultrasonic cleaning with a solution having a pH of 12 and to autoclaving at 135° C. In such aspects, the article provides fading resistance after ultrasonic cleaning thereof for at least about 45 minutes and, in still further cases, after autoclaving is performed for at least about 45 minutes. In accordance with various aspects, the dyed anodized coatings described herein may be organically dyed.

According to another aspect of the invention, an aluminum substrate may be coated according to the processes disclosed herein to create a dyed anodized coating, including an organically dyed anodized coating, having a thickness of at least about 0.01 mm and having a fading of less than $\Delta L^*$ of about 1.5, $\Delta a^*$ of about 2.0, and $\Delta b^*$ of about 2.5 values in accordance with a CIE (Commission Internationale d'Eclairage) 1976 L*, a*,b* color scale as performed in accordance with ASTM E 308, after exposure, for at least 300 cycles, to a hydrogen peroxide sterilization process. For example, the dyed anodized coating, including organically dyed anodized coatings, may exhibit these color fading values after being subjected to one or more sterilization processes. For instance, one typical method for sterilizing medical instruments is a hydrogen peroxide gas plasma sterilization process. One example of such a system is the STERRAD® sterilization system available from Advanced Sterilization Products, which is a division of Johnson & Johnson Medical, Inc. These systems typically comprise a sterilization chamber into which medical devices are placed for sterilization. A quantity of vapor phase hydrogen peroxide of relatively high concentration enters the chamber and penetrates all areas of the object being sterilized. After the hydrogen peroxide vapor is well dispersed throughout the chamber, an electromagnetic field may be applied, which drives the hydrogen peroxide into the plasma phase and completes the sterilization process. After the electromagnetic field is removed, the particles in the plasma recombine as oxygen and water, leaving behind little or no toxic residue. According to various aspects, the dyed anodized coating, including organically dyed anodized coatings, may exhibit the color fading values mentioned above after being treated in a STERRAD® hydrogen peroxide sterilization chamber, where each cycle time comprised 25 minutes of diffusion and 15 minutes of exposure to a hydrogen peroxide derived gas plasma (59% $H_2O_2$). According to a further aspect, the dyed anodized coatings disclosed herein may exhibit resistance to color fading after being subjected to one or more sterilization processes besides the hydrogen peroxide gas plasma sterilization process described above, non-limiting examples of which include ethylene oxide (ETO) sterilization, chlorine dioxide gas sterilization, autoclave steam sterilization, gamma ray sterilization, and electron beam sterilization processes.

One or more further aspects of the invention can be directed to an aluminum article comprising an anodized partially microcrystalline coating, typically of at least about 0.05 mm, and in some instances at least about 0.01 mm. The anodized coating of at least about 0.05 mm, and in some instances at least about 0.01 mm, can exhibit a Taber abrasion loss of less than about 109 mg as determined in accordance with ASTM 4060 after immersion in a sodium hydroxide solution at least about 0.04 wt % for 11 days at a temperature in a range of from about 15° C. to about 25° C.

As used herein, the term "partially microcrystalline" refers to anodic coatings that exhibit less than complete crystalline character. Partially microcrystalline metal hydroxide or partially microcrystalline metal oxides typically exhibit a repeating pattern that can be from the crystalline oxide, crystalline hydroxide, or both. Further, some aspects of the invention can be relevant to anodic coatings with partial polymicrocrystalline character from polymicrocrystalline metal oxides, polymicrocrystalline metal hydroxides, or both.

EXAMPLES

The function and advantages of these and other embodiments of the invention can be further understood from the examples below, which illustrate the benefits and/or advantages of the one or more systems and techniques of the invention but do not exemplify the full scope of the invention.

In examples 1-9, the partially microcrystalline anodic aluminum samples of the invention were prepared in accordance with the SANFORD QUANTUM® process. Samples were anodized in a solution of 250 gram/liter $H_2SO_4$ which was held at 15° C.-21° C. A voltage of 14 VDC-18 VDC was applied. Samples were immersed in ambient nickel acetate solution for 20 minutes in an ultrasonic bath, followed by treatment in a 0.4 vol % NaOH solution having a pH of about 13 units, for about five minutes. Samples were then heat treated at 250° C. for one hour and finally immersed into a nickel acetate solution at 90° C. for 40 minutes.

Conventional anodic aluminum samples were prepared by conventional type III hard anodizing process. Samples were anodized in a solution of 225 gram/Liter $H_2SO_4$ which was held at −2° C.-0° C. A voltage of from 18 VDC to 33 VDC was applied. Samples were then sealed either using ambient nickel fluoride at 25° C. for 10 minutes or nickel acetate solution at 90° C. for 20 minutes.

Double sealed aluminum samples were prepared by the SANFORD QUANTUM® process to provide a coating thickness of 0.05 mm. Samples were anodized in a solution of 250 gram/liter $H_2SO_4$ which was held at 15° C.-21° C. A voltage of 14 VDC-18 VDC was applied. Samples were immersed in ambient nickel fluoride solution for 10 minutes and followed by nickel acetate solution at 90° C. for 20 minutes.

Example 1

This example illustrates the resistance of conventional anodized aluminum substrate panels prepared according to the SANFORD QUANTUM® process to high pH conditions.

Several 4 inch×4 inch samples of various aluminum alloy panel were anodized using the SANFORD QUANTUM® process with varying coating thickness. Table 1 shows run condition for three anodic coating steps. The samples were evaluated by using an ultrasonic bath filled with general purpose cleaner agent. 30 mL of PRO•PORTION™ ultrasonic cleaning agent, from Sultan Healthcare, Englewood, N.J., was mixed with about one gallon of deionized water to make ultrasonic cleaning bath. The pH of the solution pH was adjusted about 11.0±0.2 units and maintained by adding caustic as needed. Ultrasonic energy was applied for about four to six hours while maintaining the bath temperature constant by circulating the bath to an air blower. The cosmetic appearance and dye migration were measured to determine the fail and pass mode. Each of the samples was wiped with moderate pressure using a white cotton inspection glove or high quality paper wipe soaked with reagent grade Isopropyl alcohol. Failure mode was defined as a showing of any evidence of color bleeding on the glove or wipe.

TABLE 1

Result of high pH alkaline ultrasonic cleaning

| | Coating | | STEPS INVOLVED | | | Results | |
|---|---|---|---|---|---|---|---|
| Alloy | Thickness, mm | Dye | 1st Metal Solution | Thermal Synthesis | 2nd Metal Solution | Appearance | Dye Migration |
| 6061 | 0.018 | All* | Nickel Salt for 35 min | NA | Steam Seal for >30 min | Fail | Fail |
| 5052 | 0.018 | All | Nickel Salt | NA | Steam Seal | Fail | Fail |

TABLE 1-continued

| Result of high pH alkaline ultrasonic cleaning | | | | | | | |
|---|---|---|---|---|---|---|---|
| | Coating | | STEPS INVOLVED | | | Results | |
| Alloy | Thickness, mm | Dye | 1st Metal Solution | Thermal Synthesis | 2nd Metal Solution | Appearance | Dye Migration |
| | | | for 35 min | | for >30 min | | |
| 6061 | 0.013 | Bordeaux/ Purple | Nickel Fluoride for 15 min | NA | NA | Fail | Fail |
| 6061 | 0.018 | Black | Nickel Salt for 35 min | NA | Nickel Fluoride for 10 min | Fail | Fail |
| 5052 | 0.015 | Black/ Red | Nickel Salt for 30 min | NA | DI Boiling Water | Fail | Fail |
| 6061 | 0.030 | Black | NA | NA | Nickel Salt for 35 min | Fail | Fail |

*blue, dark blue, red, black, green

Example 2

This example compares the performance of a conventional anodic coating and the partially microcrystalline anodic coating in accordance with the present invention after exposure to high pH, alkaline conditions.

Figure 8C:
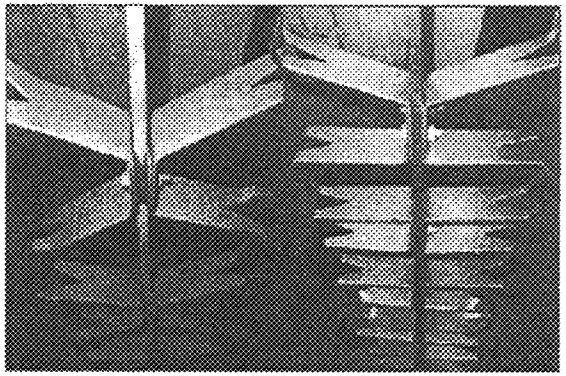
FIGS. 8B-8D are copies of photographs showing the aluminum racks having partially microcrystalline anodic coating of the present invention and racks with conventional anodic coating.
Figure 8D:
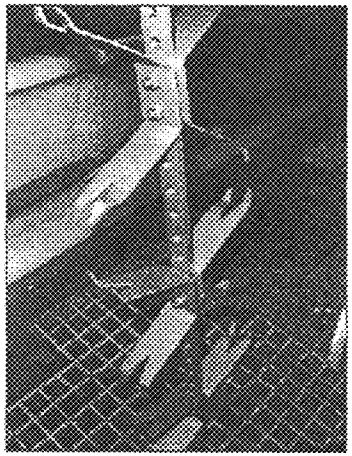
Figure 8B:
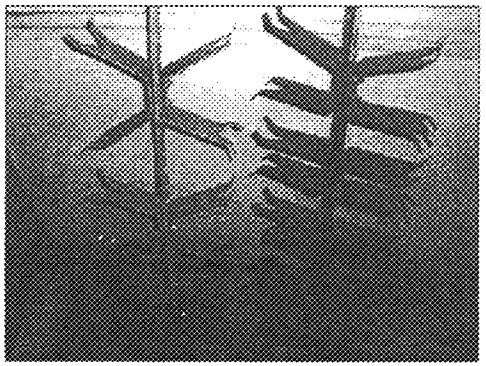
Figure 8A:
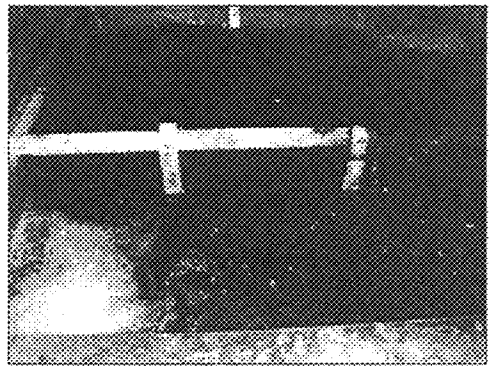
FIG. 8A is a copy of a photograph of a sodium hydroxide bath being agitated for evaluating aluminum racks having partially microcrystalline anodic coating of the present invention and the conventional anodic coating.

Two aluminum racks were prepared by hard coating using (1) the partially microcrystalline coating of the invention and (2) black dyed conventional according to the nickel acetate seal method. Each of the racks was placed in a hot etch solution containing about 120 g/liter of sodium hydroxide at 140° F. (about 60° C.). Each of the solutions was vigorously agitated with air as illustrated in FIG. 8A.

The conventionally sealed aluminum rack was completely stripped off after about two minutes. However, the coating on the rack prepared by in accordance with the present invention maintained its properties after about 20 more minutes in the hot etch solution. FIG. 8B shows the aluminum racks (left-partially microcrystalline anodic coating of the invention, right-conventional nickel acetate seal) before immersion. FIG. 8C shows the aluminum racks after immersion for 2 minutes, the rack on the left, prepared to have the partially microcrystalline anodic coating of the invention, did not show etching whereas the coating of the rack on the right, prepared with conventional nickel acetate seal, was removed. As shown in FIG. 8D, the rack, prepared to have the partially microcrystalline anodic coating of the invention, still had an acceptable coating even after immersion for 20 minutes in the alkaline bath.

Example 3

This example compares the performance of a conventional anodic coating and the partially microcrystalline anodic coating in accordance with the present invention after exposure to medical sterilization conditions.

Figure 9:
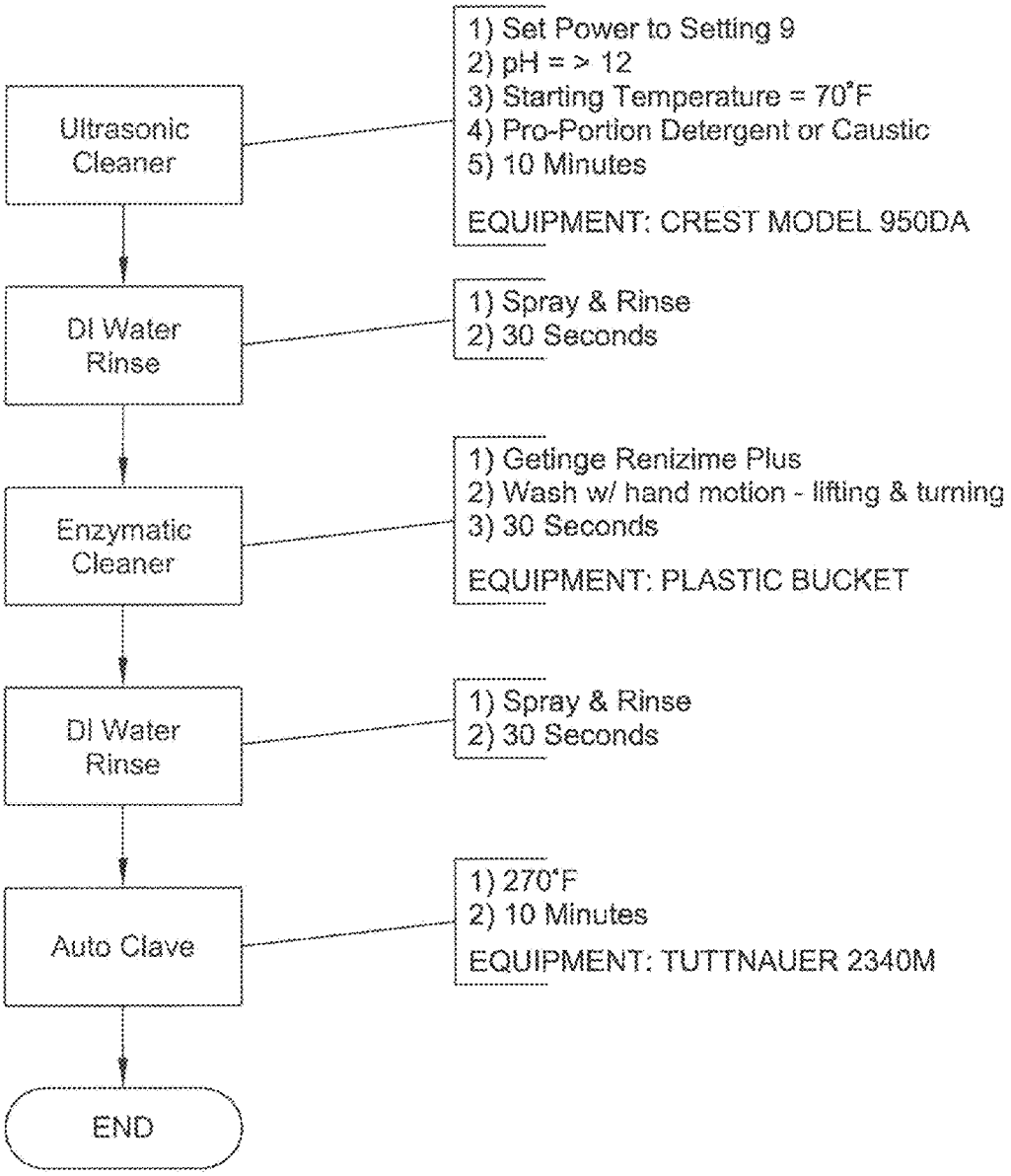
FIG. 9 a flowchart of a sterilization procedure that may be utilized to disinfect articles of the invention.

Several 4 inch×4 inch sample panels were prepared to have the partially microcrystalline anodic coating of the invention along with conventional anodic panel samples. The sample was evaluated by using the Accelerated Sterilization Procedure (ASP) illustrated in FIG. 9 which includes ultrasonic and autoclave operations. Sterilization involved transferring the sample into an ultrasonic system filled with general purpose cleaner solution. 30 mL of PRO•PORTION™ ultrasonic cleaning agent was mixed with about one gallon of deionized water to make ultrasonic cleaning bath. The pH of the solution was adjusted to be about 12.5±0.2 units and maintained by adding caustic. Ultrasonic energy was applied for about 45 minutes while maintaining the bath temperature constant. After ultrasonic cleaning, the sample panels were rinse with deionized water to remove cleaning solution. After rinsing, the sample panels were immersed into an enzymatic cleaning agent, RENUZME™ agent from Getinge USA, Inc., Rochester, N.Y., for about 30 second. The sample panels were then rinsed under deionized water for about 30 seconds to remove cleaning agent. After rinsing, the sample panels were autoclaves at 132° C. for 45 minutes. Each of the sample panels was sterilized by repeating the cycles for 4 times. Table 2 presents the results from the sterilization operations.

TABLE 2

| | | Steps Involved | | | Failure mode | |
|---|---|---|---|---|---|---|
| | Coating | 1st | | 2nd | Appeared After | |
| Color | Thickness, mm | Metal Salt Solution | Thermal Synthesis | Metal Salt Solution | Cosmetic Appearance | Dye Migration |
| Blue | 0.018 | NA | NA | Nickel Acetate: 35 min | $1^{st}$ cycle | $1^{st}$ cycle |
| Dark Blue | 0.015 | NA | NA | Nickel Acetate: 35 min | $1^{st}$ cycle | $1^{st}$ cycle |
| Bordeaux | 0.015 | NA | NA | Nickel Acetate: 35 min | $1^{st}$ cycle | $1^{st}$ cycle |
| Green | 0.018 | NA | NA | Nickel Acetate: 35 min | $1^{st}$ cycle | $1^{st}$ cycle |
| Black | 0.015 | NA | NA | Nickel Acetate: 35 min | $1^{st}$ cycle | $1^{st}$ cycle |
| Black | 0.018 | Nickel Flouride: 25 min and followed by pH = 13 | NA | Nickel Acetate: 35 min | $1^{st}$ cycle | $1^{st}$ cycle |
| Black | 0.033 | NA | NA | Nickel Acetate: 35 min | $1^{st}$ cycle | $1^{st}$ cycle |
| Black | 0.051 | | NA | Nickel Acetate: 40 min | $1^{st}$ cycle | $1^{st}$ cycle |
| Black | 0.051 | Nickel Flouride: 25 min and followed by pH = 13 w/ surfactant | At 250° C. for 1 hr | Nickel Acetate: 35 min | Passed after $4^{th}$ cycles | Passed after $4^{th}$ cycles |

Example 4

This example compares the performance of a conventional anodic coating and the partially microcrystalline anodic coating in accordance with the present invention after exposure to dishwashing conditions.

Sample aluminum panels with conventional hard coating as well as the partially microcrystalline anodic coating of the invention were prepared. The panels were placed in residential dishwashers during normal dishwashing cycles, about 60 to 90 minutes using commercially available dry detergents. Two 10 washing cycles were performed over 20 days. As presented in Table 3, which summarizes the observations and results, only the panel samples with the partially microcrystalline anodic coating finish showed no signs of functional or aesthetic property loss.

TABLE 3

| Sample ID | Anodic Coating Process | Coating Thickness | Result on Cosmetic Appearance |
|---|---|---|---|
| NA HC | Undyed conventional | 0.046 mm | Failed |
| NA HC | Black dyed conventional | 0.046 mm | Failed |
| NA | Undyed SANFORD QUANTUM ® | 0.046 mm | Failed |
| NA | Black dyed SANFORD QUANTUM ® | 0.046 mm | Failed |
| SB | Undyed, partially microcrystalline | 0.046 mm | Passed |
| SB | Black dyed, partially microcrystalline | 0.053 mm | Passed |

Example 5

This example compares the performance of a conventional anodic coating and the partially microcrystalline anodic coating in accordance with the present invention after soaking in a solution of 0.04% sodium hydroxide.

Two aluminum samples were prepared with the partially microcrystalline anodic coating of the invention. A conventional aluminum anodic coating sample panel was also prepared. The surface of each of the sample panels was scratched by scuffing with a metal grate. The scratched panels were soaked in a 0.04% solution of sodium hydroxide and water (pH of 11.6 to 12.3) for 24 hours. The panels were abraded and soaked for 3 or more cycles and the cosmetic appearance of each was evaluated after each cycle by scratching the surface using metal grate. Table 4 presents the observations after scratching.

TABLE 4

| ID | Process | Coating Thickness | Abrasion and Cosmetic Failure Mode Appearance Cycles |
|---|---|---|---|
| NA | Undyed conventional | 0.051-0.061 mm | 1st |
| SB | Undyed, partially microcrystalline anodic coating | 0.051-0.061 mm | >3rd |
| SB | Black dyed, partially microcrystalline anodic coating | 0.051-0.061 mm | >3rd |

Example 6

This example evaluates conventional anodic coatings and the partially microcrystalline anodic coating of the invention after exposure to low pH conditions, sulfuric acid immersion.

Aluminum samples were prepared with the partially microcrystalline anodic coating of the invention. Three conventional anodic coating samples using different seal conditions were prepared from 1 inch×1 inch 6061 aluminum alloy coupons. The coating thickness and weight of each of the samples was determined according to ASTM B 137. The samples were soaked in 0.71 vol % aqueous sulfuric acid solution, having a pH of 0.8 units, for 24 hours. The coating thickness and weight were measured after immersion in the sulfuric acid solution and compared with initial values. The results and observations of the samples are presented in Table 5. The data notes that all three conventional anodic coatings were completely dissociated in the aqueous sulfuric solution, i.e., the mass of the coatings were completely removed from the aluminum surface. Further, bare aluminum appeared to be attacked by the acid solution as indicated by a negative weight loss. In contrast, the partially microcrystalline anodic coating aluminum sample of the present invention showed a coating thickness loss of 20% and weight loss of 31%. Furthermore, the partially microcrystalline anodic coating sample of the invention appeared to maintain its hardness and integrity.

TABLE 5

| | | Coating Thickness, mm | | Coating Mass, grams | |
|---|---|---|---|---|---|
| ID | Process | Before | After | Before | After |
| Invention | Partially microcrystalline Anodizing | 0.044 | 0.036 | 0.2642 | 0.1812 |
| Convention | Classic Hardcoat followed by nickel acetate seal | 0.051 | 0.0 | 0.2624 | −0.4910 |
| Convention | Quantum Hardcoat followed by nickel acetate seal | 0.044 | 0.0 | 0.2312 | −0.3349 |
| Convention | Quantum Hardcoat followed by nickel fluoride seal | 0.043 | 0.0 | 0.2246 | −0.3658 |

Example 7

This example compares the abrasion resistance of a conventional anodic aluminum coating and the partially microcrystalline anodic aluminum coating of the invention.

Taber abrasion among the three samples, a partially microcrystalline anodic aluminum sample of the invention, a double sealed anodic aluminum sample (prepared by nickel fluoride treatment followed by nickel acetate treatment), and a conventional anodic aluminum coating having coating thickness of 0.05 mm (2.0 mil), were evaluated after soaking each in sodium hydroxide for 3 and 11 days at ambient temperature.

Figure 10B:
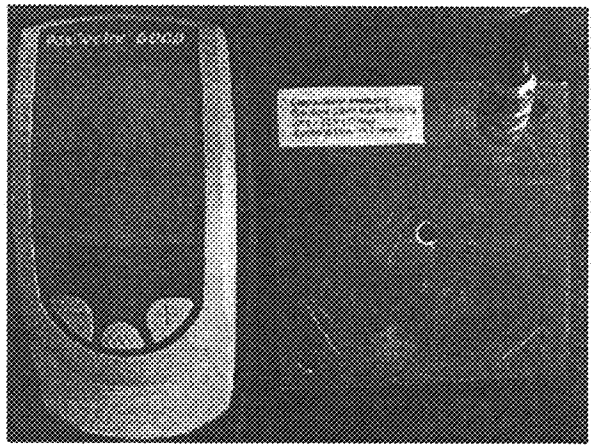
FIGS. 10A-10C are copies of photographs showing the abrasion performance of a partially microcrystalline anodic coating of the invention (FIG. 10C) and conventional anodic coating (FIG. 10B)
Figure 10C:
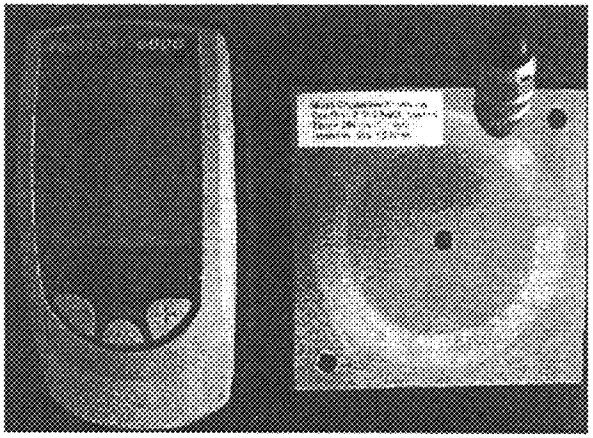
Figure 10A:
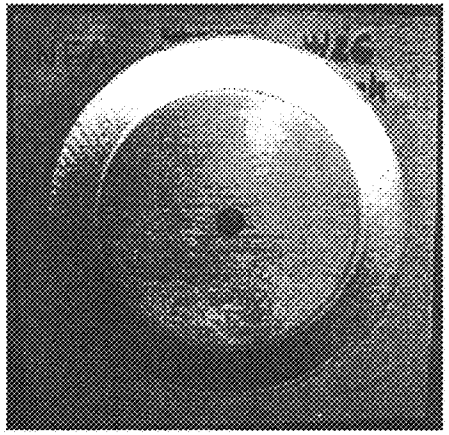

FIG. 10A is a copy of a photograph of the 3 days old double sealed anodic aluminum sample after performing the Taber procedure. It indicated entire coating thickness loss showing bare aluminum surface in the abrasion area.

The 11 days old partially microcrystalline anodic aluminum sample of the invention had less coating thickness loss from 0.05 mm (2.0 mil) to 0.038 mm (1.5 mil) after performing the Taber procedure. FIG. 10B is a copy of a photograph showing the appearance of 3 days old conventional anodic coating after abrasion testing and FIG. 10C a copy of a photograph showing the appearance of the 11 days old partially microcrystalline anodic coating after abrasion testing.

Example 8

This example evaluates the phase transformation of metal hydroxide product into metal oxide solids via thermal treatment during the partially microcrystalline anodic coating of the invention.

Figure 11A:
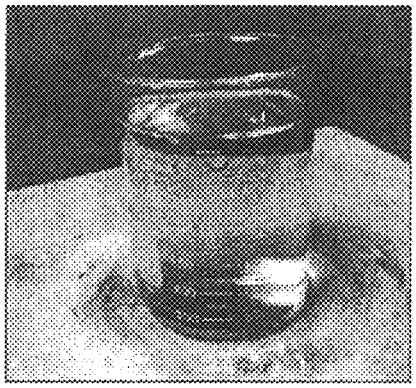
FIGS. 11A-11E are copies of photographs showing phase transformation of metal hydroxide product into metal oxide solids via thermal treatment relevant to the partially microcrystalline anodic coating of the invention.
Figure 11B:
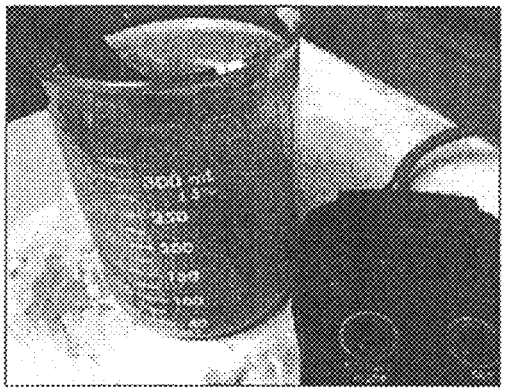
Figure 11C:
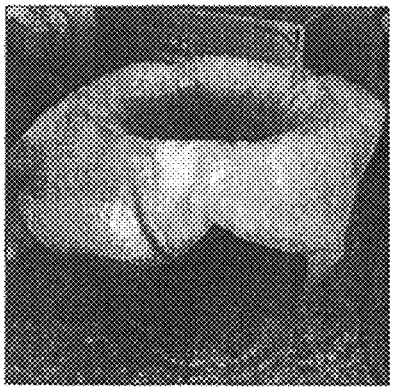
Figure 11D:
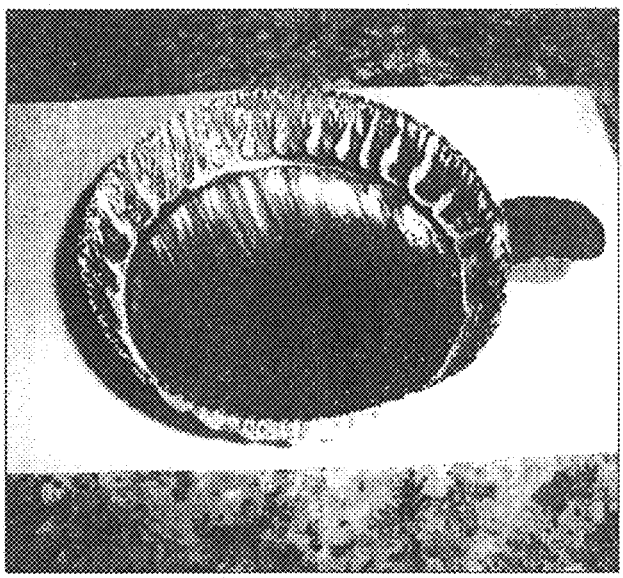

Metal salt solution including nickel acetate having 5.0 wt % was prepared as illustrated in FIG. 11A. The pH of the solution was increased to about 10.0 units by adding aqueous sodium hydroxide, NaOH, solution. The solution became greenish turbid, which is indicative of nickel hydroxide precipitation, as illustrated in FIG. 11B. The precipitate was filtered using a No. 40 Whatman filter paper, as illustrated in FIG. 11C. The filter paper with the precipitate was dried at 60° C. for 1 hour. The dried green colored precipitate, nickel hydroxide, was collected in a weigh dish as illustrated in FIG. 11D and heated in an oven at 250° C. for 1 hour.

Figure 11E:
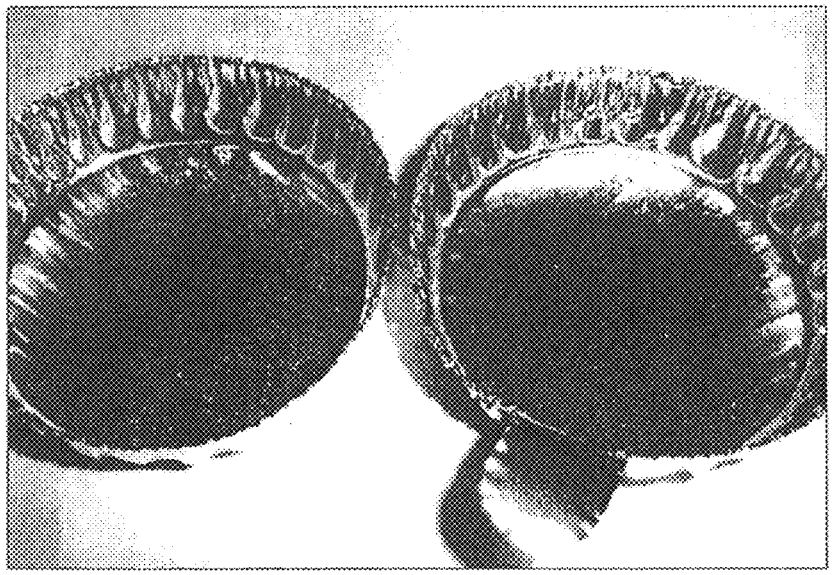

The green precipitate became black particles after the thermal treatment. The black particles are believed to be nickel oxide, $Ni_2O_3$. FIG. 11E shows the green precipitate (on the left) before thermal synthesis, showing greenish color particles, nickel hydroxide, and the thermally treated particles (on the right) which are black color particles of nickel oxide.

Example 9

This example illustrates a slightly different process for preparing partially microcrystalline anodic aluminum samples.

Samples were anodized in a solution of 250 gram/liter $H_2SO_4$ which was held at 15° C.-21° C. A voltage of 14 VDC-18 VDC was applied. The samples were then immersed in ambient nickel salt solution for 20 minutes in an ultrasonic bath, followed by treatment in a 0.4 vol % NaOH solution having a pH of about 13 minutes, for about five minutes. Samples were then heat treated at 250° C. for one hour and finally immersed into a nickel salt solution at 90° C. for 40 minutes.

Example 10

This is a second example that compares the performance results between a conventional anodic coating and an anodic coating prepared according to the processes of the present invention after exposure to a sterilization process.

In this example, undyed and organically dyed samples were prepared in accordance with processes of the invention. Samples were anodized in a solution of 250 gram/liter $H_2SO_4$ which was held at 15° C.-21° C. A voltage of 14 VDC-18 VDC was applied. The samples were then immersed in metal salt solution that contained at least one of nickel, iron, zinc, copper, magnesium, titanium and zirconium metal species, and dissolved fluoride for 10-30 minutes. The metal salt solution had a temperature in a range from about 85° F. to about 95° F. (about 29° C. to about 35° C.), a pH in a range from 5.8 to 6.2, and had a nickel species concentration in a range from about 0.8-1.1 wt % and a fluoride ion concentration in a range from 500-650 ppm in highly purified water. This was followed by treatment in an alkaline solution comprising 0.1 g/L NaOH having a pH in a range from 8-13, for 3-5 minutes. Surfactant was also added to the alkaline solution at a concentration of 2 ppm-100 ppm. The samples then underwent a hydrothermal sealing process where they were immersed in a high temperature aqueous solution (i.e., a second aqueous metal solution) that comprised water soluble metal salts including at least one of nickel, magnesium, titanium, and/or zirconium acetate for 20-45 minutes. The solution had a temperature in a range from about 185° F. to about 195° F. (about 85° C. to about 90.5° C.), a pH in a range from 5.0 to 5.4, and had a metal acetate species concentration in a range from about 4.8-5.2 wt % in highly purified water. The samples were then subjected to a hydrothermal synthesis step using pressurized steam in a high temperature, high pressure chamber. This process included heating the samples from a temperature of about 120° C. (autogenous pressure: 15 psi) to about 150° C. (autogenous pressure: 70 psi) for a duration of 20 minutes to five hours. Dyed materials were prepared using a dipping technique for at least 2 minutes.

Conventional organically dyed and undyed anodic aluminum samples were prepared by conventional type III hard anodizing process. Samples were anodized in a solution of 225 gram/Liter $H_2SO_4$ which was held at −2° C.-0° C. A voltage in a range from 18 VDC to 33 VDC was applied. Samples were then sealed either using ambient nickel fluoride at 25° C. for 10 minutes or nickel acetate solution at 90° C. for 20 minutes.

The test samples were loaded and cycled in a STERRAD® 100NX® hydrogen peroxide sterilization chamber (manufactured by Advanced Sterilization Products). The samples were run for the indicated number of sterilization cycles listed in Tables 6 and 7 below and then removed for evaluation. Each cycle time comprised 25 minutes of diffusion and 15 minutes of exposure to a hydrogen peroxide derived gas plasma (59% $H_2O_2$), for a total time of 40 minutes at a temperature of 55° C. for a total of 300 cycles. The undyed samples were silk screened with a silk screen print. The results from the undyed samples are listed below in Table 6, and the results from the dyed samples are listed in Table 7. The results were visually inspected and rated according to the chart shown below. In the tables below, the term "N/A" implies the sample was not tested, since a failure mode had been previously identified.

TABLE 6

Undyed Silk Screened Samples

| Anodic | Printed Ink Remaining on Silk Screen (%) STERRAD ® 100NX ® Cycle | | | |
|---|---|---|---|---|
| Coating | 10 cycles | 50 cycles | 190 cycles | 295 cycles |
| Convention (8 samples) | 50% | N/A | N/A | N/A |
| Invention (4 samples) | 100% | 100% | 100% | 80% |
| Invention (4 samples) | 100% | 100% | 100% | 100% |

TABLE 7

Organically dyed Samples

| | | Color Retention (%) STERRAD ® 100NX ® Cycle | | | | |
|---|---|---|---|---|---|---|
| Anodic Coating | Color | 5 cycles | 20 cycles | 100 cycles | 200 cycles | 300 cycles |
| Convention | Black | 80% | 50% | 0% | N/A | N/A |
| Convention | Green | 50% | 30% | 0% | N/A | N/A |
| Convention | Bordeaux | 30% | 20% | 0% | N/A | N/A |
| Convention | Blue | 80% | 50% | 0% | N/A | N/A |
| Invention | Black | 100% | 100% | 80% | 80% | 80% |

TABLE 7-continued

| Organically dyed Samples | | | | | | |
|---|---|---|---|---|---|---|
| | | Color Retention (%) STERRAD ® 100NX ® Cycle | | | | |
| Anodic Coating | Color | 5 cycles | 20 cycles | 100 cycles | 200 cycles | 300 cycles |
| Invention | Green | 100% | 100% | 80% | 80% | 80% |
| Invention | Bordeaux | 100% | 75% | 50% | 50% | 50% |
| Invention | Blue | 100% | 100% | 100% | 100% | 100% |

The results from Tables 6 and 7 indicate that the samples prepared according to the processes discloses herein retained color and silk screen patterns much better than those prepared according to conventional methods. For instance, none of the silk screened samples prepared using the conventional method failed to retain any of the silk screen pattern after 50 cycles, whereas half the samples prepared using the disclosed method retained 80% of the silk screen pattern after 295 cycles, and the other half retained 100% of the silk screen pattern after 295 cycles. Likewise, none of the organically dyed samples that were coated using the conventional method retained their color after 100 cycles, whereas the blue color sample prepared according to the invention retained 100% of its color after 300 cycles, the black and green samples prepared according to the invention retained 80% of their color after 300 cycles, and the red sample prepared according to the invention retained 50% of its color after 300 cycles. This indicates that organically dyed and undyed anodized aluminum materials that are coated according to the methods disclosed herein have much less fading and retain printed patterns much better than materials prepared according to conventional methods. Without being bound by theory, it is believed that the coating processes disclosed herein form a much better barrier later at the surface of the metal substrate that functions to eliminate or substantially reduce a point of access into the coating of corrosive chemical or plasma processes that would otherwise enter the pores and cause fading and pattern removal.

Having now described some illustrative embodiments of the invention, it should be apparent to those skilled in the art that the foregoing is merely illustrative and not limiting, having been presented by way of example only. Numerous modifications and other embodiments are within the scope of one of ordinary skill in the art and are contemplated as falling within the scope of the invention. In particular, although many of the examples presented herein involve specific combinations of method acts or system elements, it should be understood that those acts and those elements may be combined in other ways to accomplish the same objectives.

Those skilled in the art should appreciate that the parameters and configurations described herein are exemplary and that actual parameters and/or configurations will depend on the specific application in which the systems and techniques of the invention are used. Those skilled in the art should also recognize or be able to ascertain, using no more than routine experimentation, equivalents to the specific embodiments of the invention. It is therefore to be understood that the embodiments described herein are presented by way of example only and that, within the scope of the appended claims and equivalents thereto; the invention may be practiced otherwise than as specifically described.

Moreover, it should also be appreciated that the invention is directed to each feature, system, subsystem, or technique described herein and any combination of two or more features, systems, subsystems, or techniques described herein and any combination of two or more features, systems, subsystems, and/or methods, if such features, systems, subsystems, and techniques are not mutually inconsistent, is considered to be within the scope of the invention as embodied in the claims. Further, acts, elements, and features discussed only in connection with one embodiment are not intended to be excluded from a similar role in other embodiments.

As used herein, the term "plurality" refers to two or more items or components. The terms "comprising," "including," "carrying," "having," "containing," and "involving," whether in the written description or the claims and the like, are open-ended terms, i.e., to mean "including but not limited to." Thus, the use of such terms is meant to encompass the items listed thereafter, and equivalents thereof, as well as additional items. Only the transitional phrases "consisting of" and "consisting essentially of," are closed or semi-closed transitional phrases, respectively, with respect to the claims. Use of ordinal terms such as "first," "second," "third," and the like in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

What is claimed is:

1. A method of coating an anodized aluminum substrate comprising:

immersing the anodized aluminum substrate in a first aqueous metal salt solution comprising at least one metal cationic species for a first predetermined length of time to form a partially impregnated aluminum substrate;

immersing the partially impregnated aluminum substrate in an alkaline solution for a second predetermined length of time to form a fully impregnated aluminum substrate; and immersing the fully impregnated aluminum substrate in a second aqueous metal salt solution comprising at least one metal acetate and having a pH in a range of from about 5 units to about 6 units for a third predetermined length of time to form a coated anodized aluminum substrate.

2. The method of claim 1, wherein the first predetermined length of time is less than 30 minutes.

3. The method of claim 2, wherein the concentration of metal cationic species in the first aqueous metal salt solution is from about 0.5 to about 1.0 wt %.

4. The method of claim 3, wherein the metal cationic species is selected from the group consisting of nickel, iron, zinc, copper, magnesium, titanium, zirconium, and mixtures thereof.

5. The method of claim 4, wherein the first aqueous metal salt solution further comprises a surfactant.

6. The method of claim 4, wherein the metal cationic species is a fluoride of at least one of nickel, iron, zinc, copper, magnesium, titanium and zirconium.

7. The method of claim 6, wherein immersing the anodized aluminum substrate in the first aqueous metal salt solution comprises applying ultrasonic energy.

8. The method of claim 6, wherein the concentration of fluoride ion is in a range from about 300 ppm to about 800 ppm.

9. The method of claim 1, wherein the alkaline solution further comprises a surfactant at a concentration up to about 200 ppm.

10. The method of claim 1, wherein the second predetermined length of time is for a period of from about 3 minutes to about 8 minutes.

11. The method of claim 1, wherein the alkaline solution comprises at least one of sodium hydroxide and potassium hydroxide.

12. The method of claim 1, wherein the third predetermined length of time is for a period of from about 20 minutes to about 45 minutes.

13. The method of claim 12, wherein the second aqueous metal salt solution has a temperature in a range of from about 80° C. to about 95° C.

14. The method of claim 13, wherein the at least one metal acetate comprises at least one of nickel acetate, magnesium acetate, titanium acetate, and zirconium acetate.

15. The method of claim 14, wherein the concentration of the at least one metal acetate in the second aqueous metal salt solution is from about 4.5 wt % to about 6.5 wt %.

16. The method of claim 1, further comprising thermally treating the fully impregnated aluminum substrate in an oxidizing atmosphere at a temperature in a range of from about 110° C. to about 350° C. for a period of at least about 20 minutes.

17. The method of claim 16, wherein thermally treating the fully impregnated anodized aluminum substrate comprises heating the fully impregnated anodized aluminum substrate at a temperature in a range of from about 135° C. to about 300° C. for a period of at least about 30 minutes.

18. The method of claim 16, wherein the fully impregnated anodized aluminum substrate is thermally treated prior to immersing in the second aqueous metal salt solution.

19. The method of claim 1, further comprising subjecting the coated anodized aluminum substrate to a hydrothermal synthesis process.

20. The method of claim 19, wherein the hydrothermal synthesis process comprises heating the anodized aluminum substrate in a chamber at a temperature of at least 110° C. and a pressure of at least 15 psi for a period of between about 20 minutes to about five hours.

21. An aluminum article comprising an anodized coating with a thickness of at least about 0.01 mm, wherein the anodized coating is dyed and has a fading of less than $\Delta L^*$ of about 1.5, $\Delta a^*$ of about 2.0, and $\Delta b^*$ of about 2.5 values in accordance with a CIE (Commission Internationale d'Eclairage) 1976 L*, a*, b* color scale as performed in accordance with ASTM E 308, after exposure, for at least one cycle of a sterilization process.

22. The aluminum article of claim 21, wherein the at least one cycle is at least 300 cycles.

23. The aluminum article of claim 22, wherein the sterilization process is a hydrogen peroxide sterilization process.

24. The aluminum article of claim 23, wherein each cycle includes 25 minutes of diffusion and 15 minutes of exposure to a hydrogen peroxide derived gas plasma.

25. The aluminum article of claim 21, wherein the anodized coating is organically dyed.

* * * * *